US006929593B1

(12) United States Patent
Chen

(10) Patent No.: US 6,929,593 B1
(45) Date of Patent: Aug. 16, 2005

(54) MACHINE FOR SPREADING OUT CARDBOARD BOXES AUTOMATICALLY

(75) Inventor: Tuan-Mei Chiu Chen, Chia Yi Hsien (TW)

(73) Assignee: Tien Heng Machinery Co., Ltd., Chia-Yi Hsien (TW)

( * ) Notice: Subject to any disclaimer, the term of this patent is extended or adjusted under 35 U.S.C. 154(b) by 0 days.

(21) Appl. No.: 10/770,453

(22) Filed: Feb. 4, 2004

(51) Int. Cl.[7] ..... B31B 1/88
(52) U.S. Cl. ..... 493/55; 493/123
(58) Field of Search ..... 493/55, 123, 128; 53/136.4, 382.1

(56) References Cited

U.S. PATENT DOCUMENTS 4,892,513 A * 1/1990 Kwiek ..... 493/316
5,054,262 A * 10/1991 Hertel et al. ..... 53/381.1
5,165,582 A * 11/1992 Andrews ..... 223/99
6,080,095 A * 6/2000 Chen ..... 493/309
6,699,165 B1 * 3/2004 Krieger et al. ..... 493/122
6,764,436 B1 * 7/2004 Mazurek ..... 493/120

* cited by examiner

*Primary Examiner*—Eugene Kim
(74) *Attorney, Agent, or Firm*—Rosenberg, Klein & Lee

(57) ABSTRACT

A machine is provided for spreading out cardboard boxes automatically, which is structured such that cardboards can be held in a holding mechanism upright and closely side by side, and fed to a main body one after another, and which have sucking disks for drawing the cardboards to spread out the same; the sucking disks can be adjusted in position as well as length of space between them; the machine further has a bending mechanism for bending bottom shutter portions of the cardboard boxes after the cardboard boxes are spread out; adhesive tapes are automatically applied onto the bottom of the boxes to seal the boxes after the bottom shutter portions of the boxes are bent.

8 Claims, 26 Drawing Sheets

MACHINE FOR SPREADING OUT CARDBOARD BOXES AUTOMATICALLY

BACKGROUND OF THE INVENTION

1. Field of the Invention

The present invention relates to a machine for spreading out cardboard boxes automatically, more particularly one, which is structured such that cardboards can be held in a holding mechanism upright and closely side by side, and fed to a main body one after another, and which have several adjustable sucking disks for drawing the cardboards to spread out the same, and a bending mechanism for bending bottom shutter portions of the cardboards after the cardboards are spread out; the machine further can apply adhesive tapes onto the bottom of the boxes to seal the cardboard boxes.

2. Brief Description of the Prior Art

Cardboard boxes have many different uses, and a lot of cardboards boxes are used for packaging objects and merchandises every day. Automatic machines for spreading out cardboard boxes with are available, which can help increase efficiency of packaging. Such automatic machines usually can fold the bottom shutter portions of cardboard boxes as well as joined the bottom shutter portions with adhesive tapes, too.

However, conventional automatic machines for spreading out cardboard boxes usually have the following disadvantages:

1. They are very large in size therefore they will occupy too much space in a factory, and cause problems in arranging machines of the factory.
2. With the conventional machines, those cardboard boxes that have upper shutter portions can't be fed to the spreading mechanisms of the machines side by side and in an upright position when they are in the flat non-spread out position.
3. Sucking disks of the machines can't be adjusted in the size of the space between them for suiting cardboard boxes of different sizes.

SUMMARY OF THE INVENTION

It is a main object of the present invention to provide a machine for spreading out cardboard boxes automatically to overcome the above disadvantages.

The machine is structured such that cardboards can be held in a holding mechanism upright and closely side by side, and fed to a main body one after another, and which have a sucking disk set including several sucking disks for drawing the cardboards to spread out the same; the sucking disks can be adjusted in position as well as length of space between them; the machine further has a bending mechanism for bending bottom shutter portions of the cardboard boxes after the cardboard boxes are spread out; adhesive tapes are automatically applied onto the bottom of the boxes to seal the boxes after the bottom shutter portions of the boxes are bent.

The sucking disk set has a support board, slide blocks, and slide rails; the disks are fitted to the support board with adjustment screw bolts; the support board is pivoted to an upright rod, and is joined to the slide blocks at a lower end, which slide blocks are fitted on the slide rails, and securely joined to an output rod of a horizontal cylinder such that the sucking disks can be horizontally displaced.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
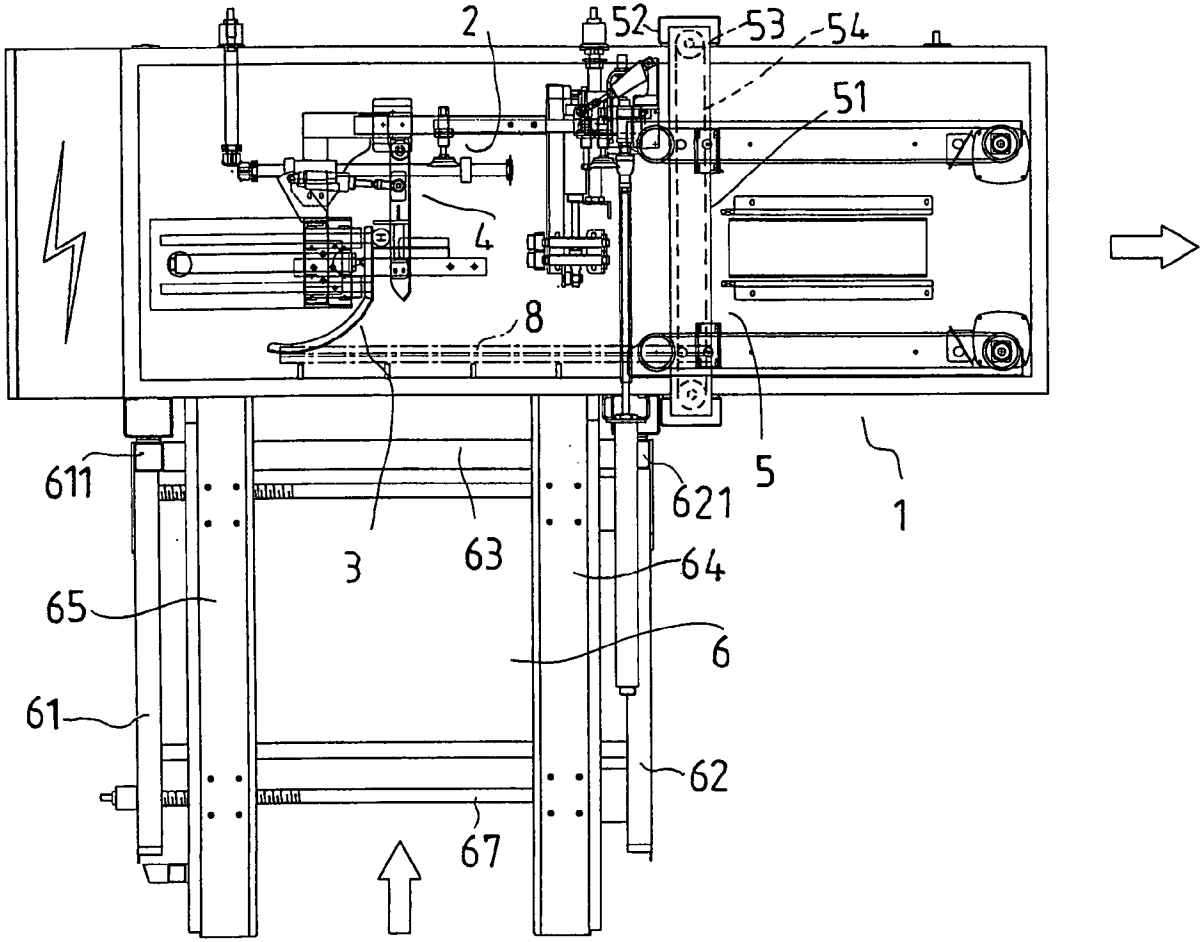
FIG. 1 is a top view of the machine of the present invention.
Figure 2:
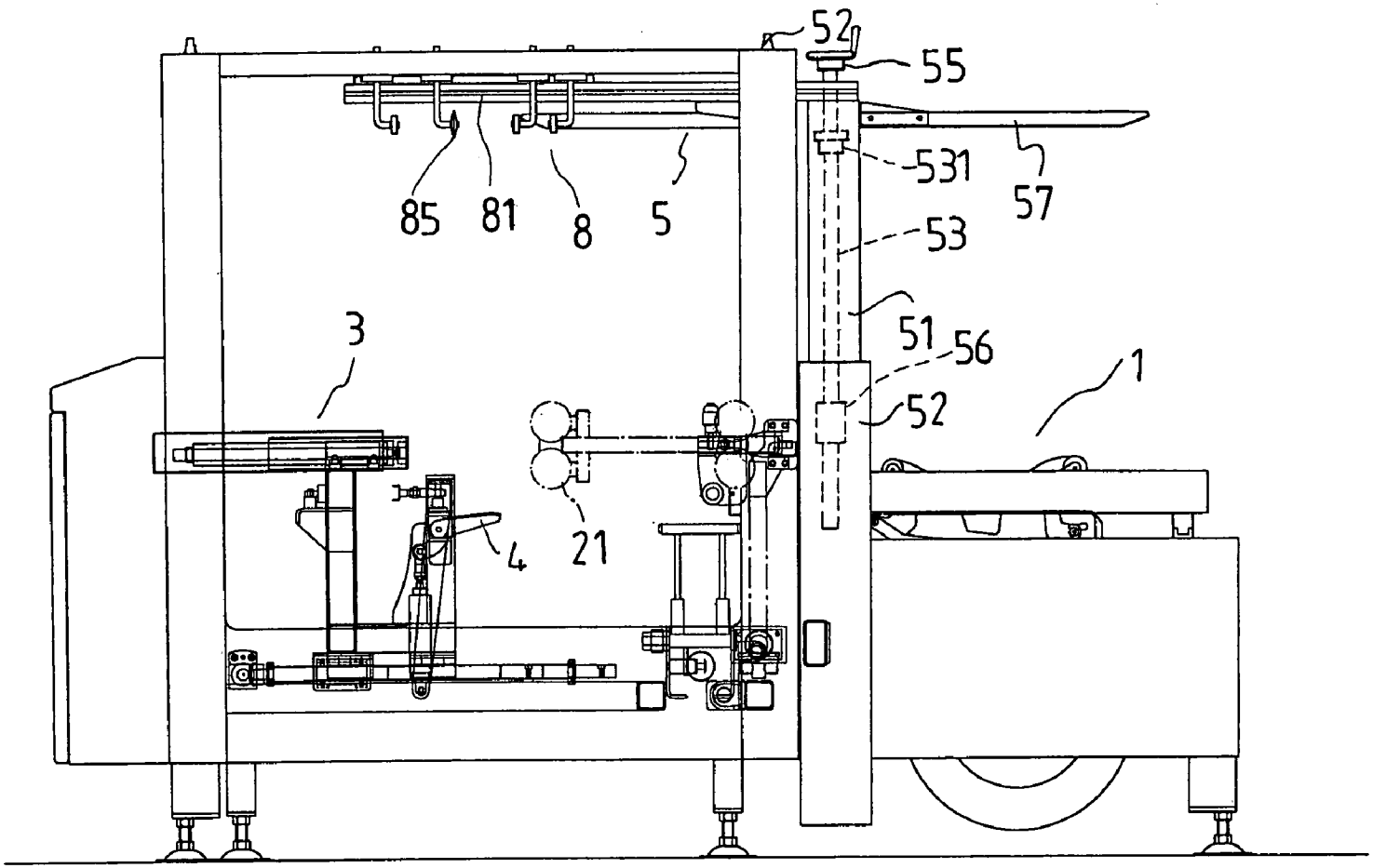
FIG. 2 is a front view of the machine of the present invention.
Figure 3:
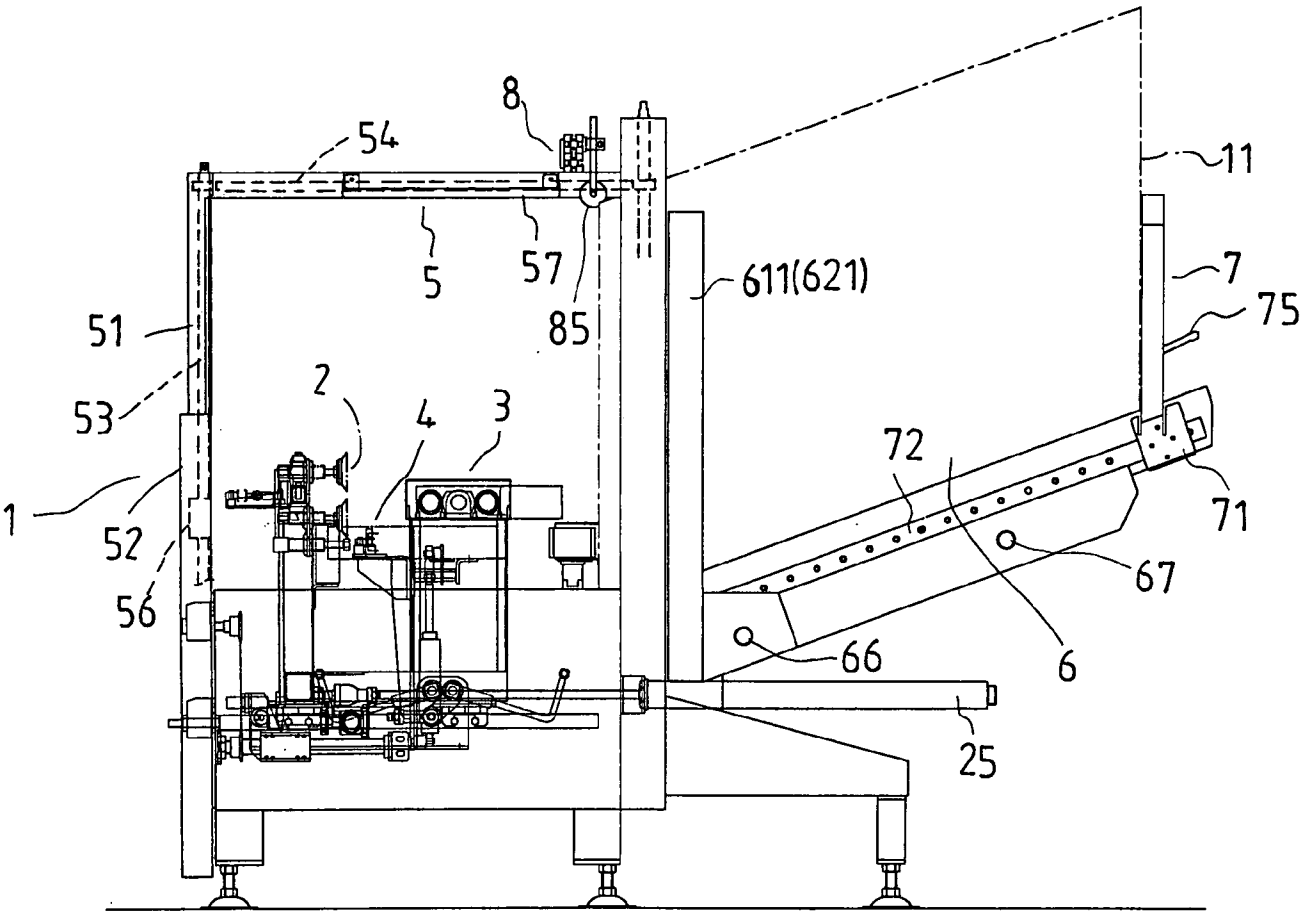
FIG. 3 is a side view of the machine of the present invention.
Figure 4:
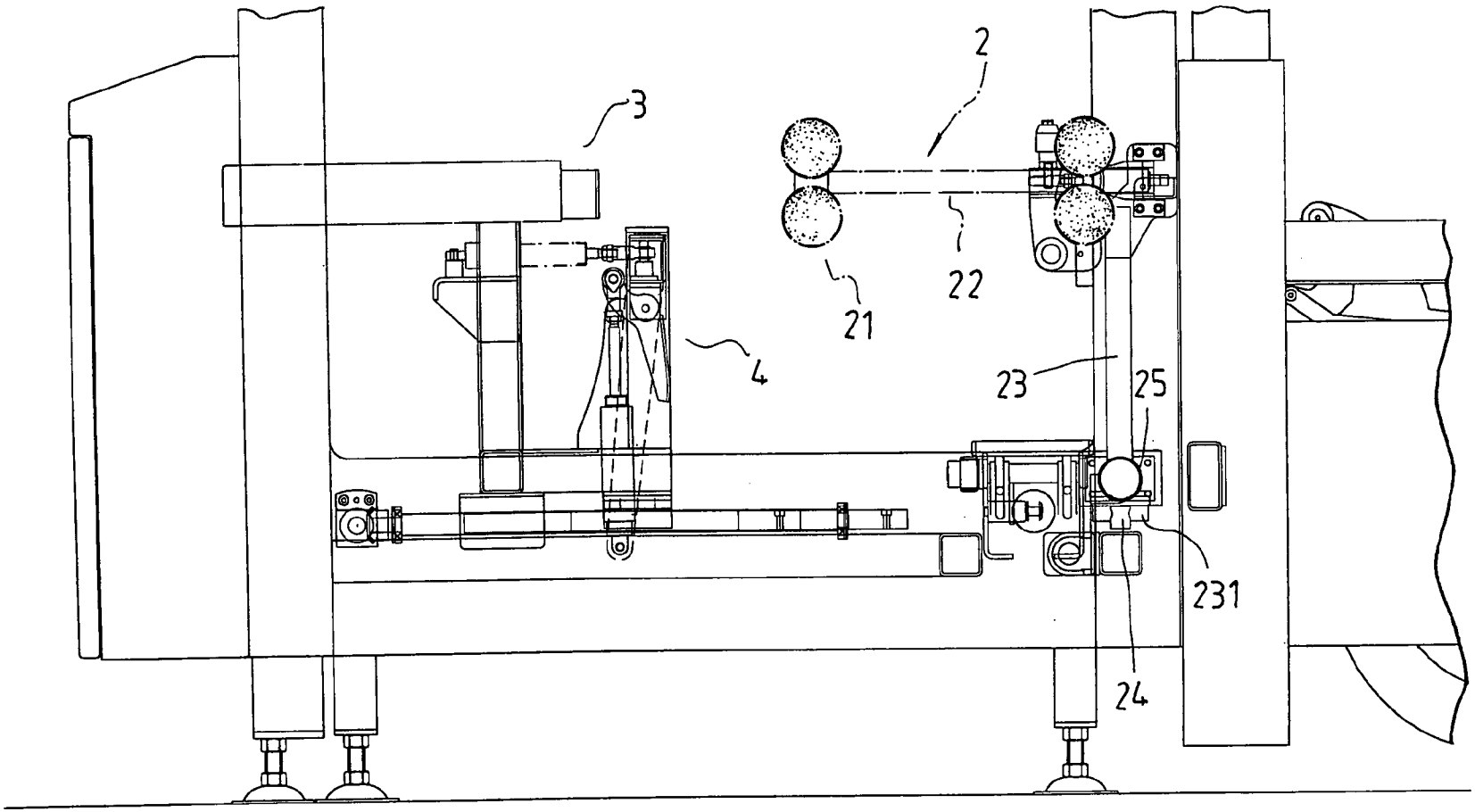
FIG. 4 is a first partial front view of the machine of the invention.
Figure 5:
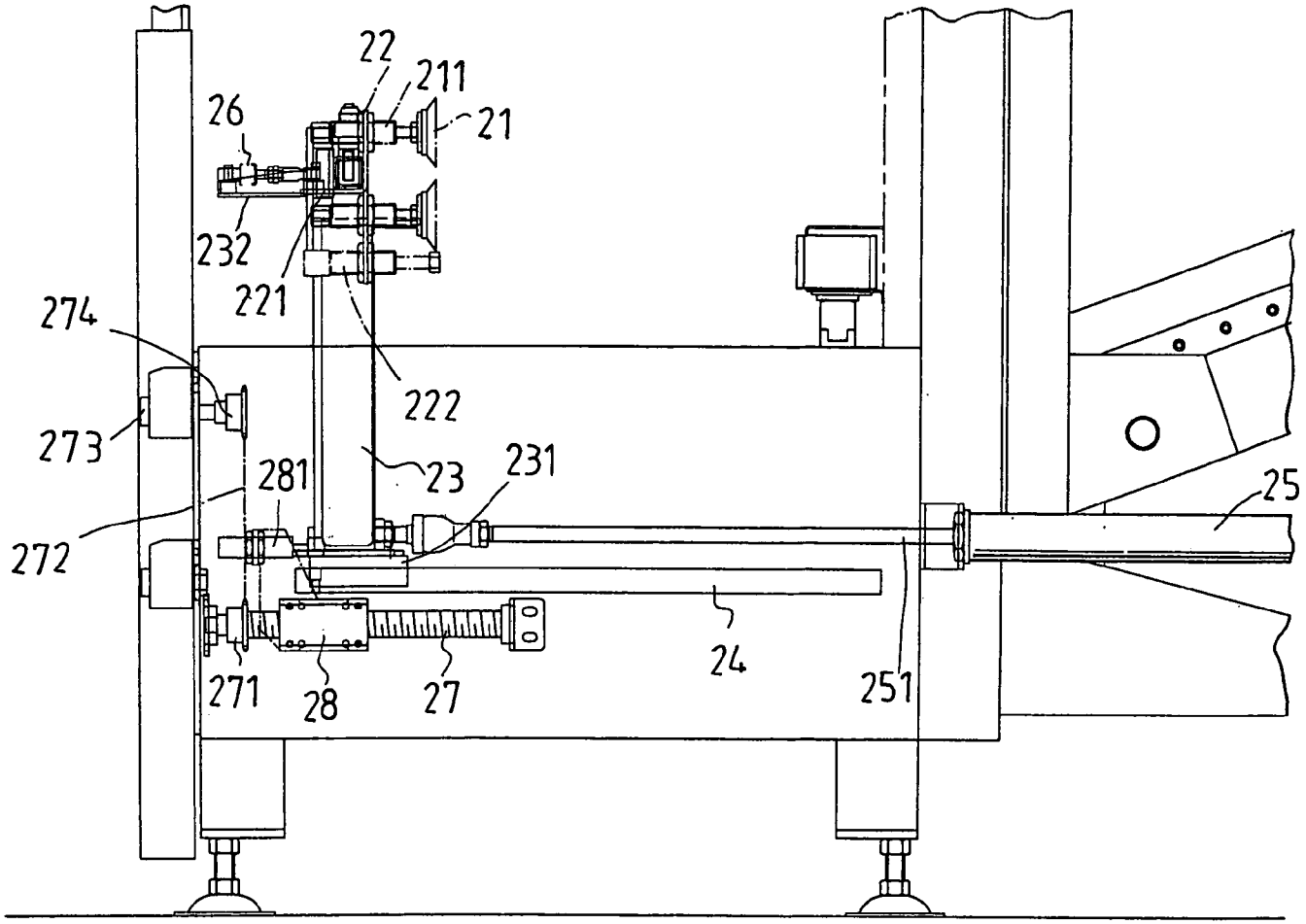
FIG. 5 is a first partial side view of the machine of the invention.
Figure 6:
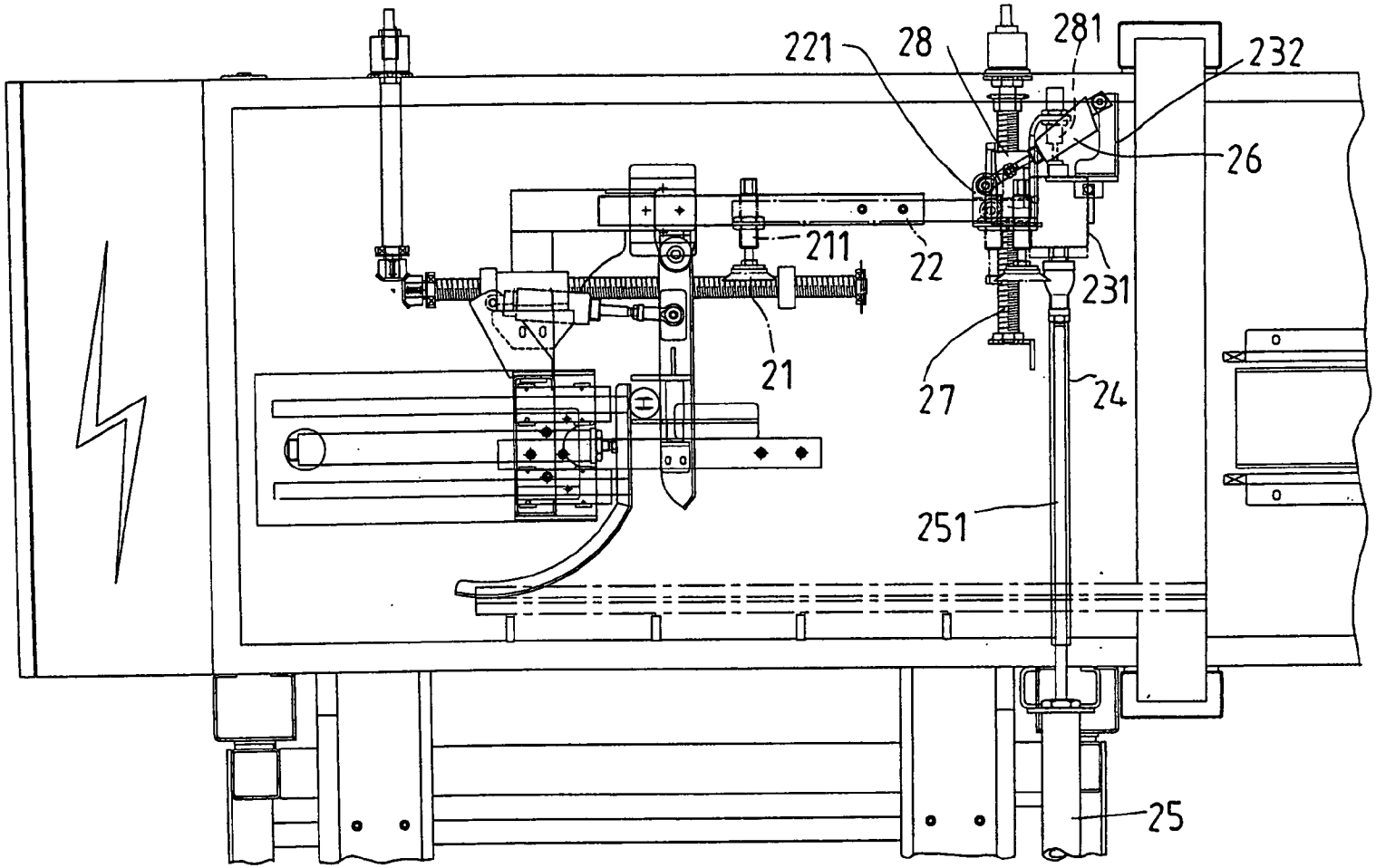
FIG. 6 is a first partial top view of the machine of the invention.
Figure 7:
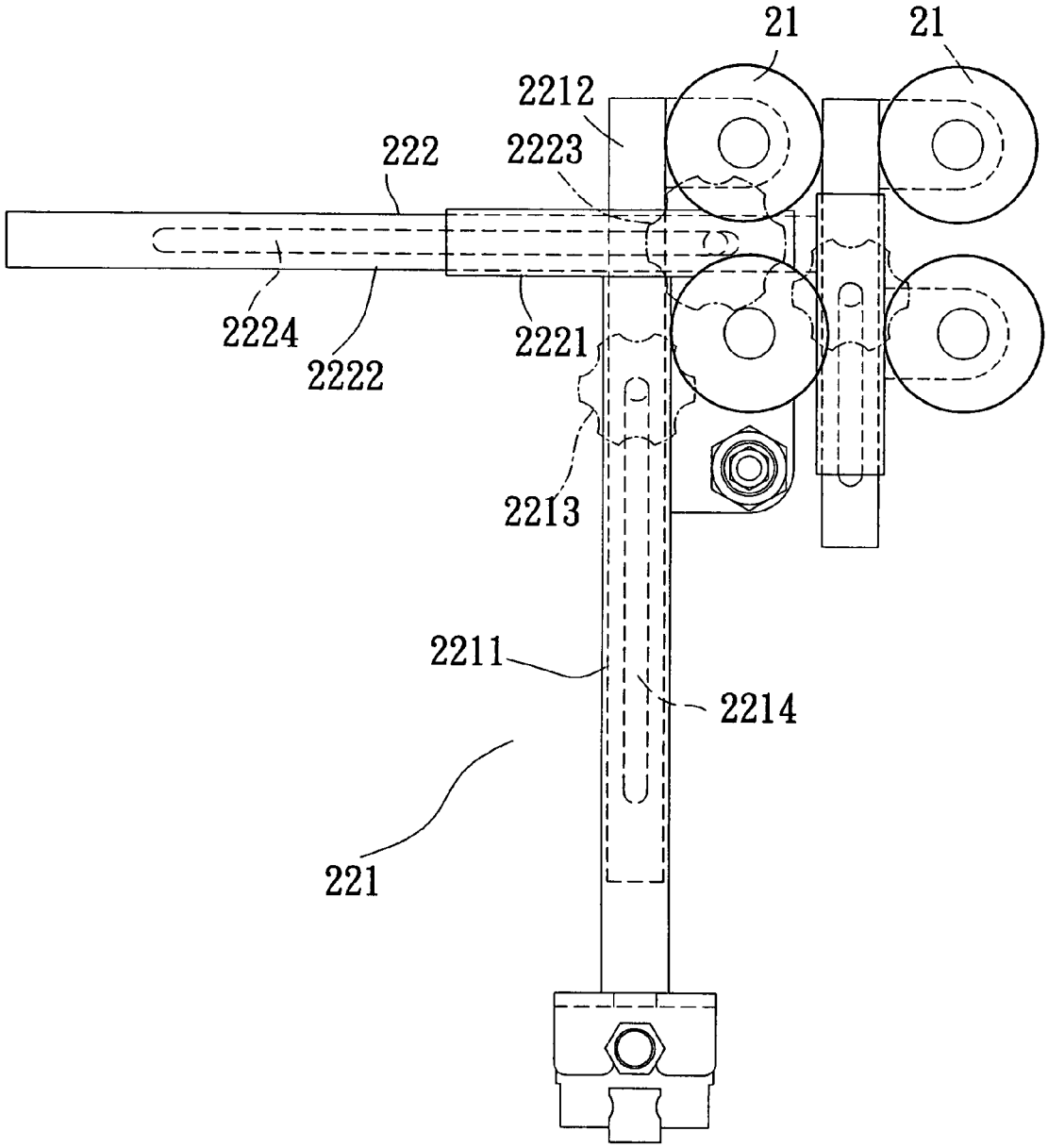
FIG. 7 is a partial front view of the sucking disk set of the machine of the present invention.
Figure 8:
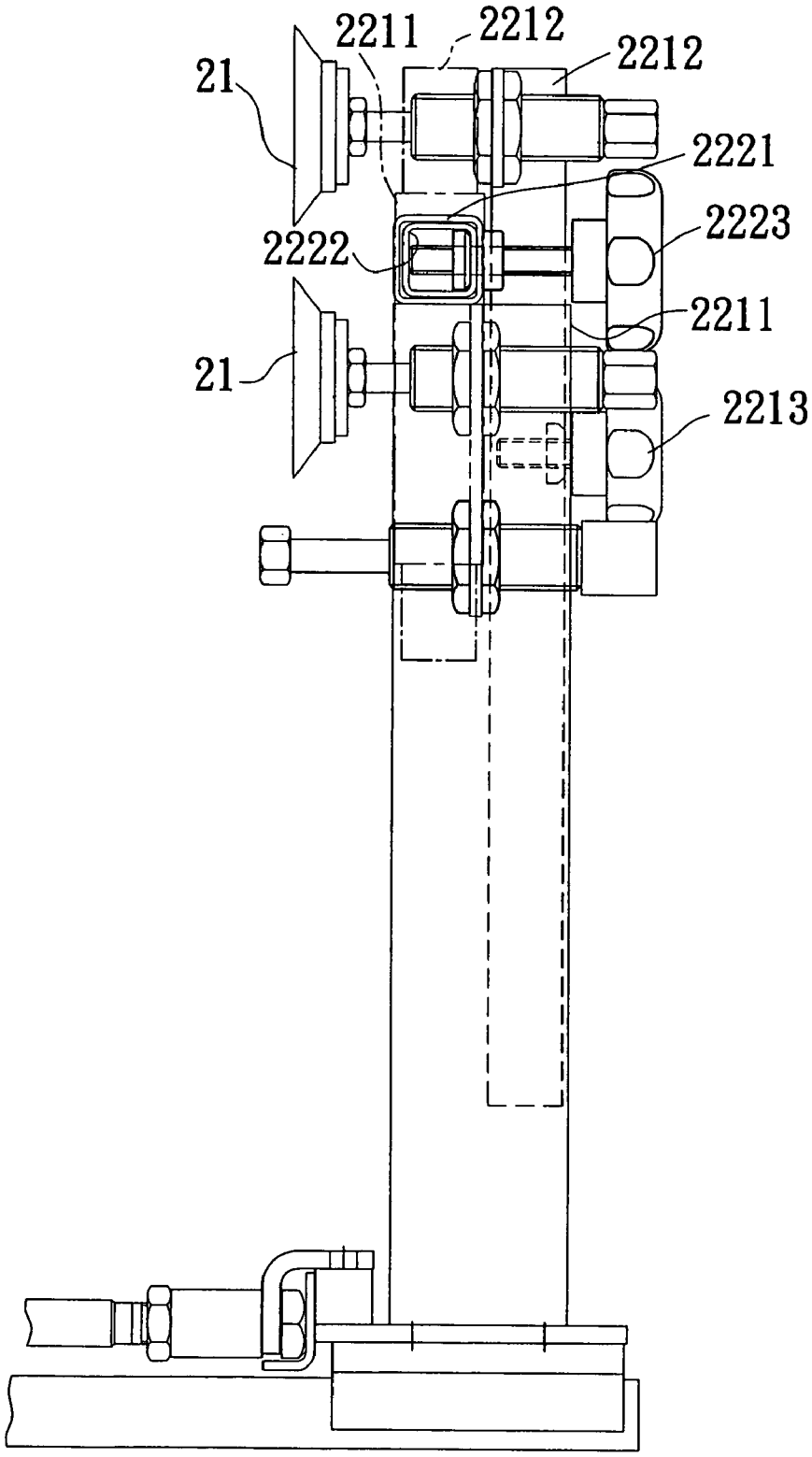
FIG. 8 is a partial side view of the sucking disk set.
Figure 9:
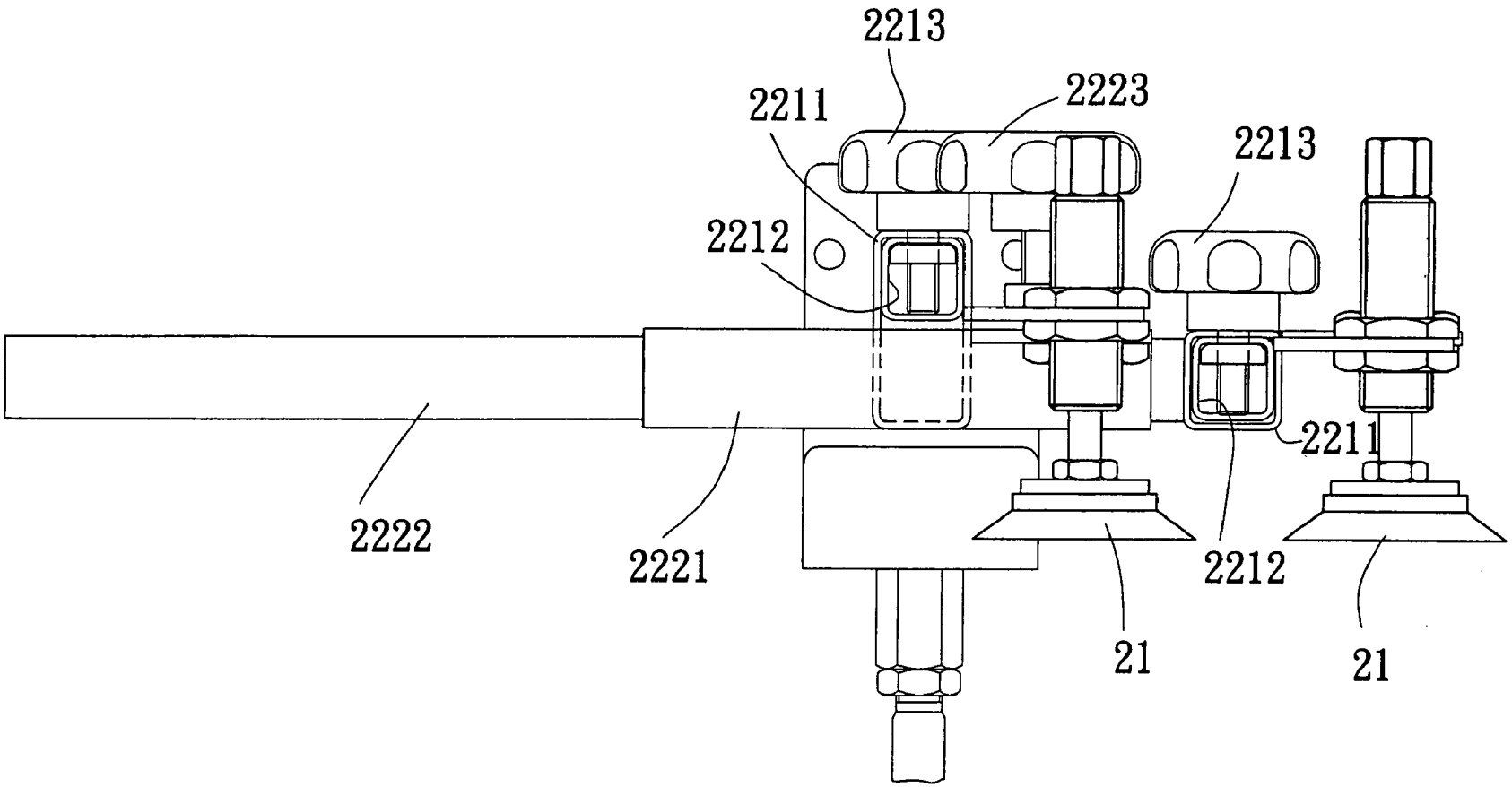
FIG. 9 is a partial top view of the sucking disk set.
Figure 10:
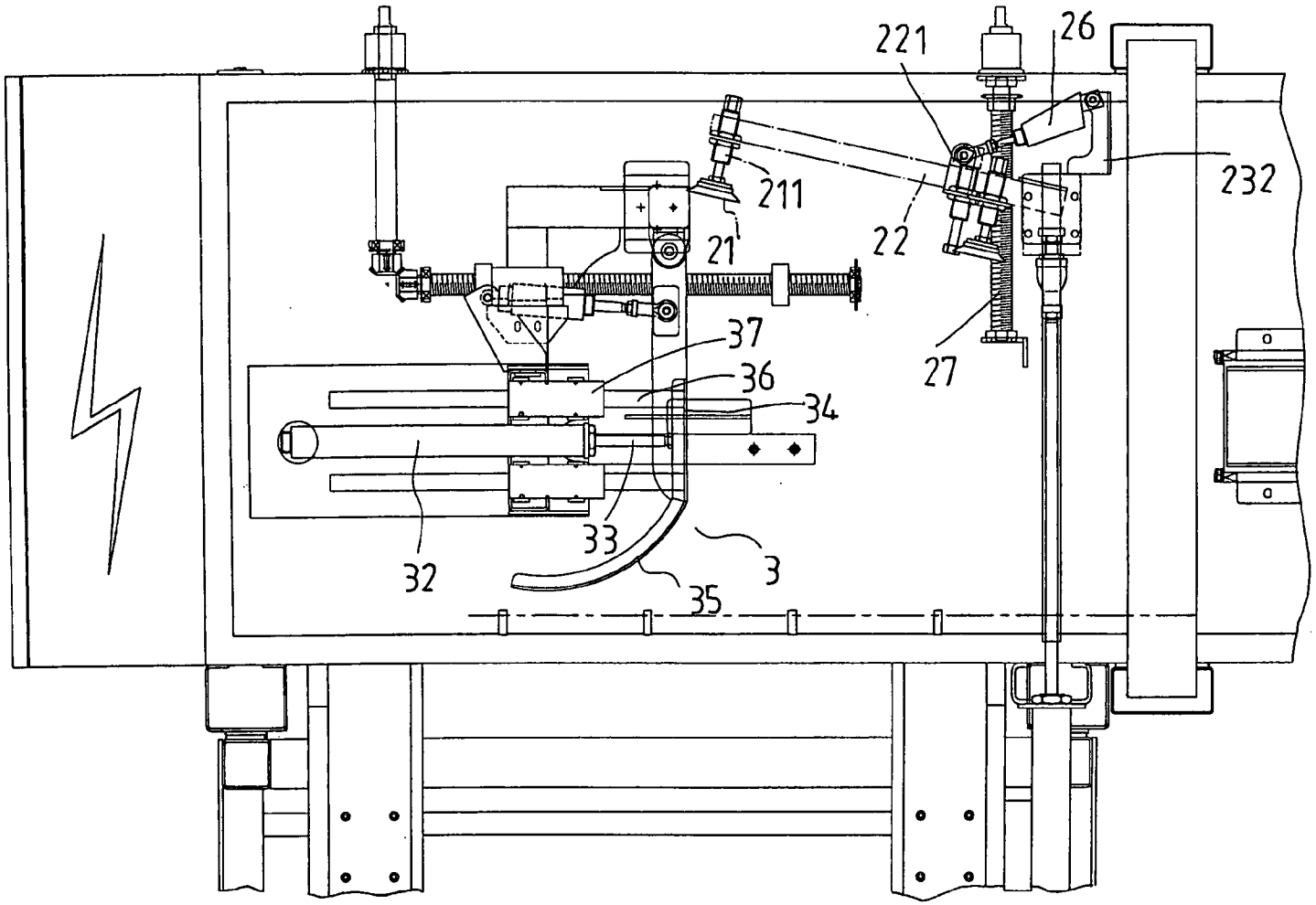
FIG. 10 is a second partial top view of the machine of the invention.
Figure 11:
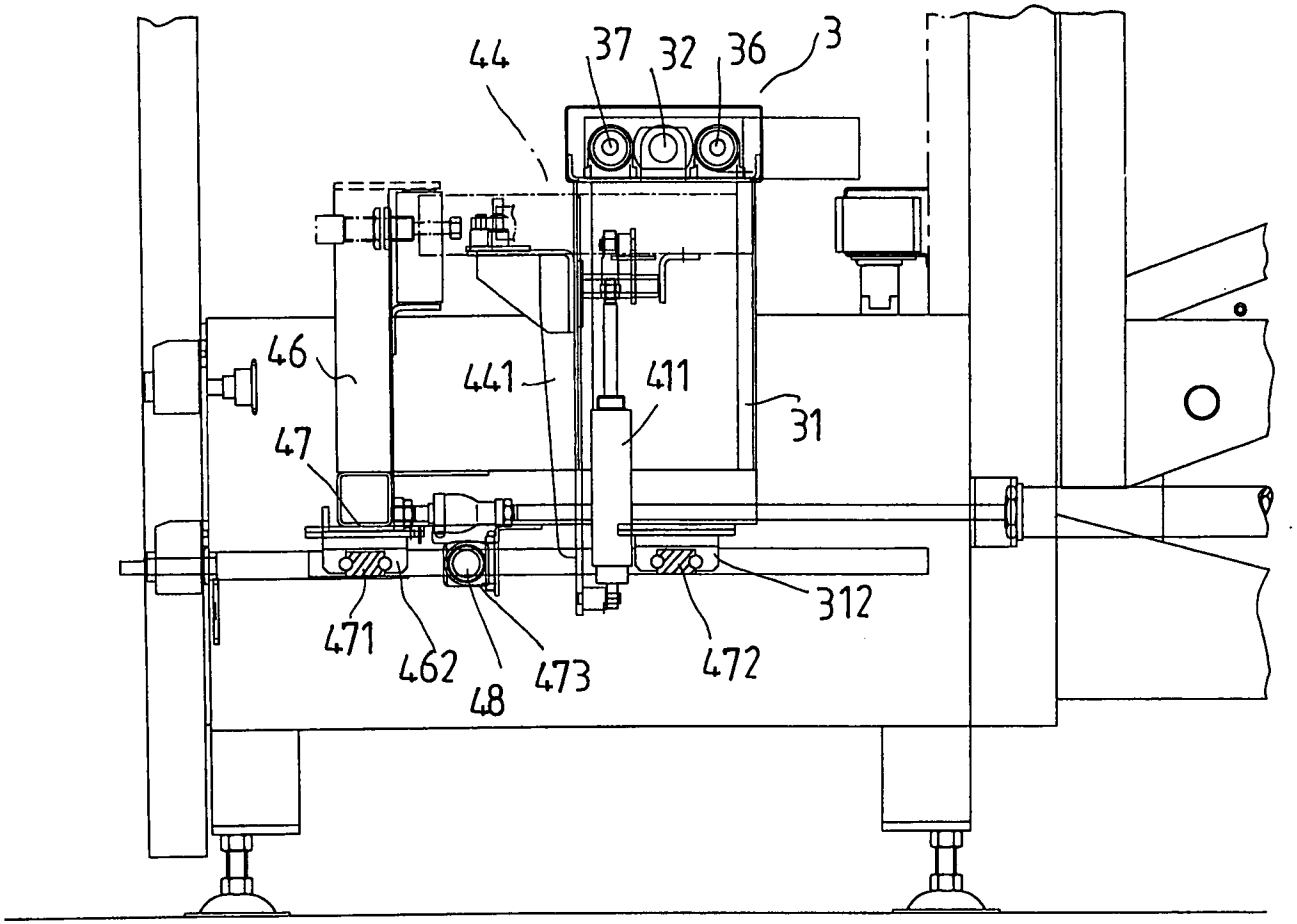
FIG. 11 is a second partial side view of the machine of the invention.
Figure 12:
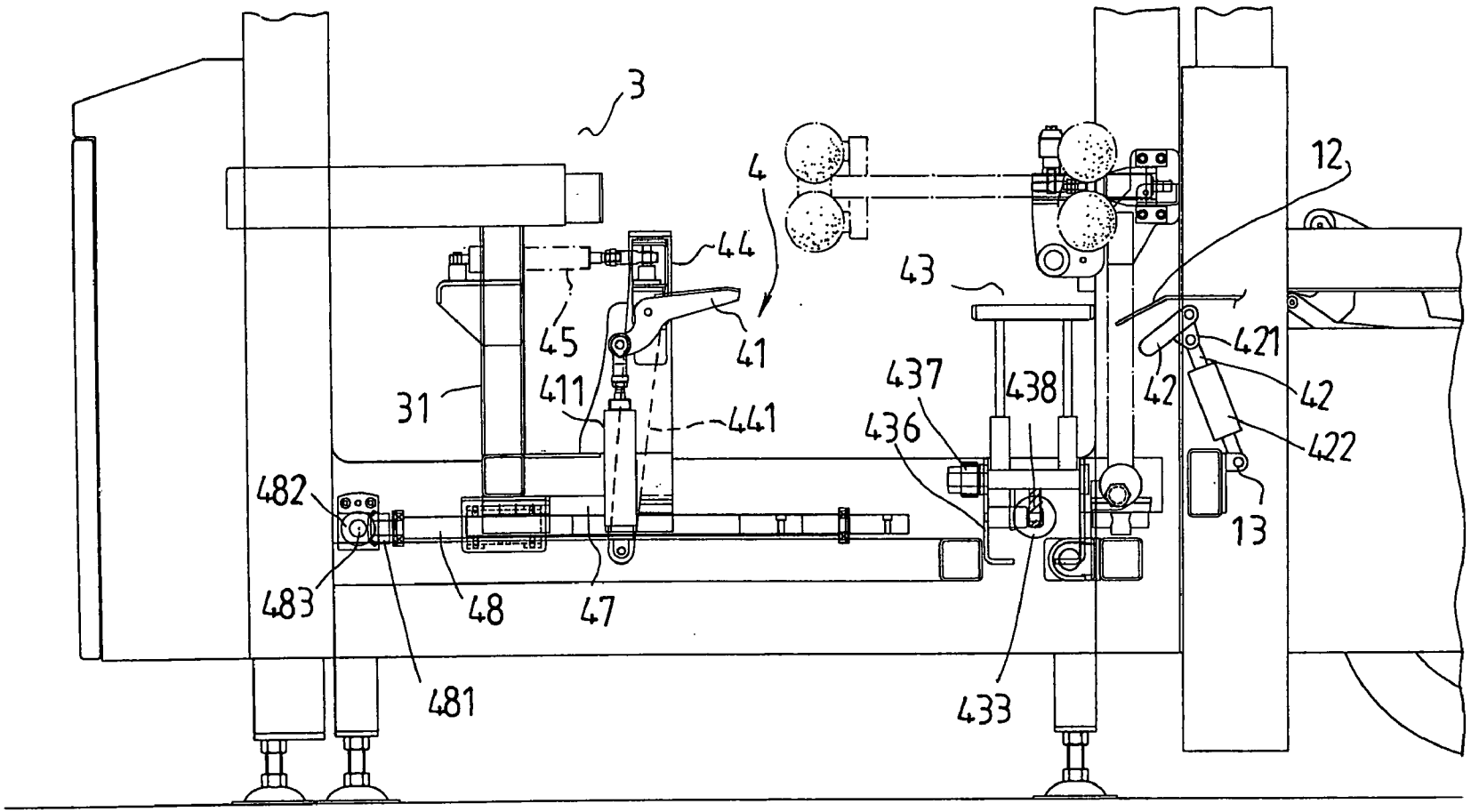
FIG. 12 is a second partial front view of the present machine.
Figure 13:
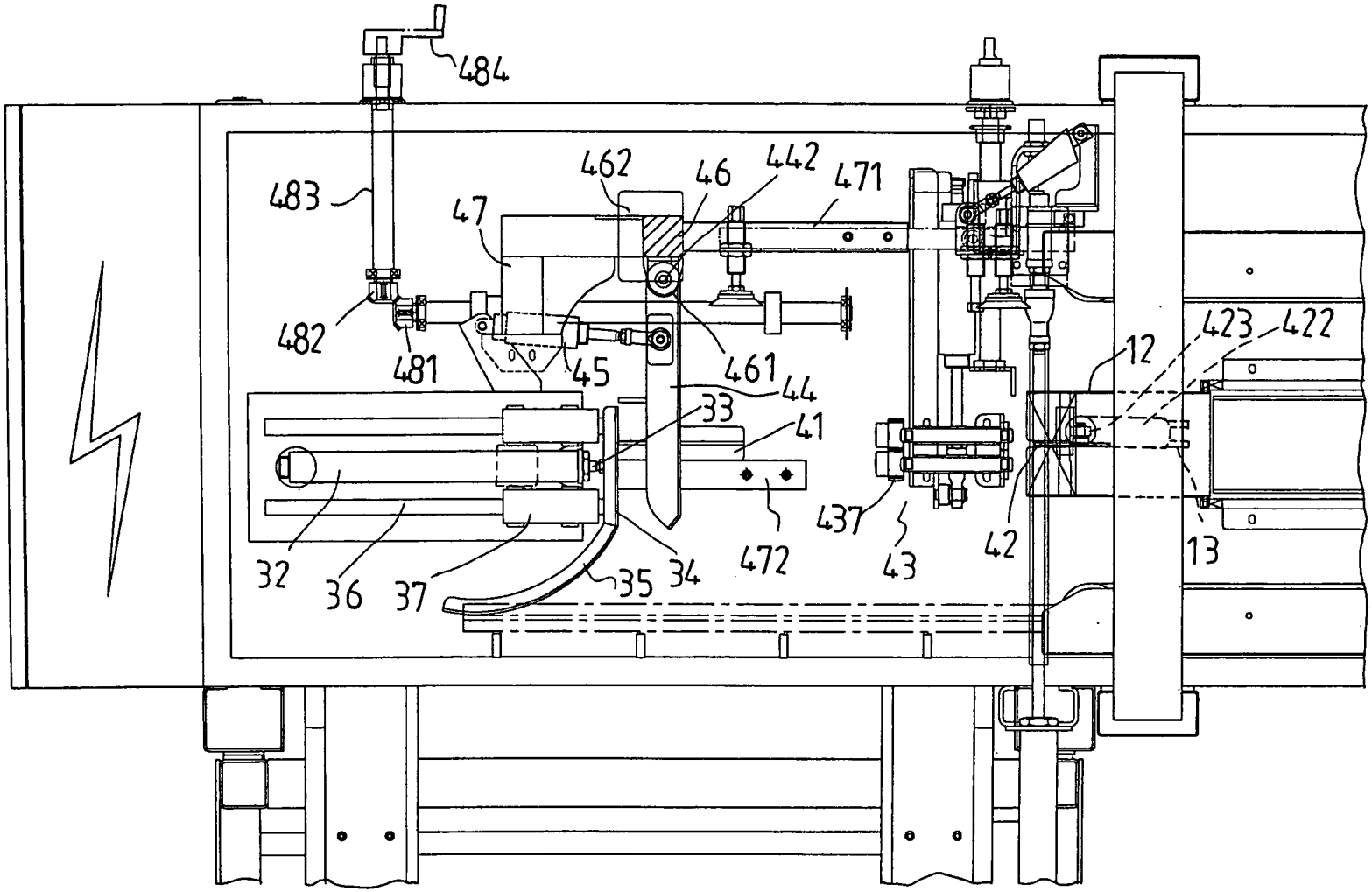
FIG. 13 is a third partial top view of the machine of the invention.
Figure 14:
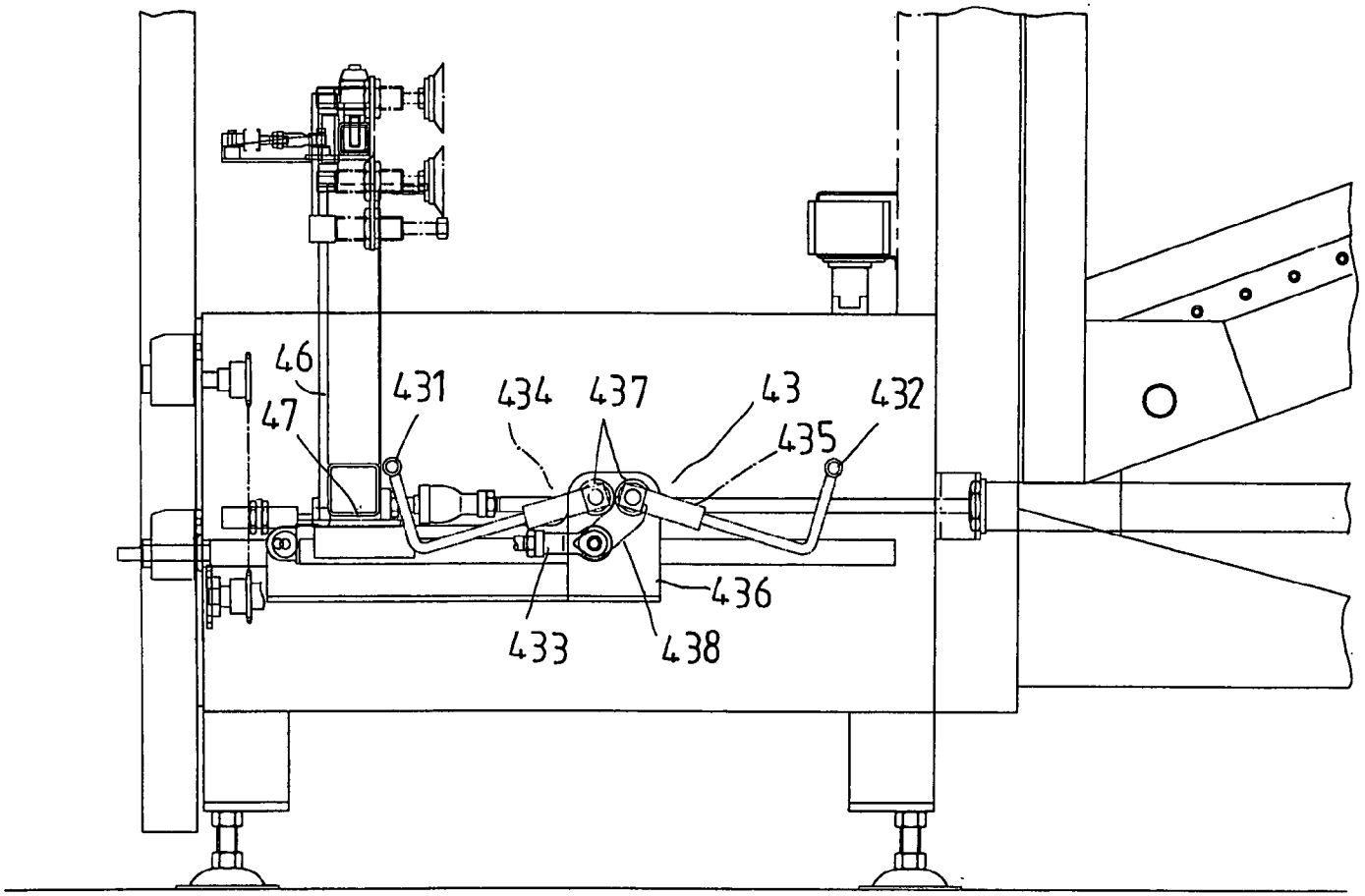
FIG. 14 is a third partial side view of the machine of the invention.
Figure 15:
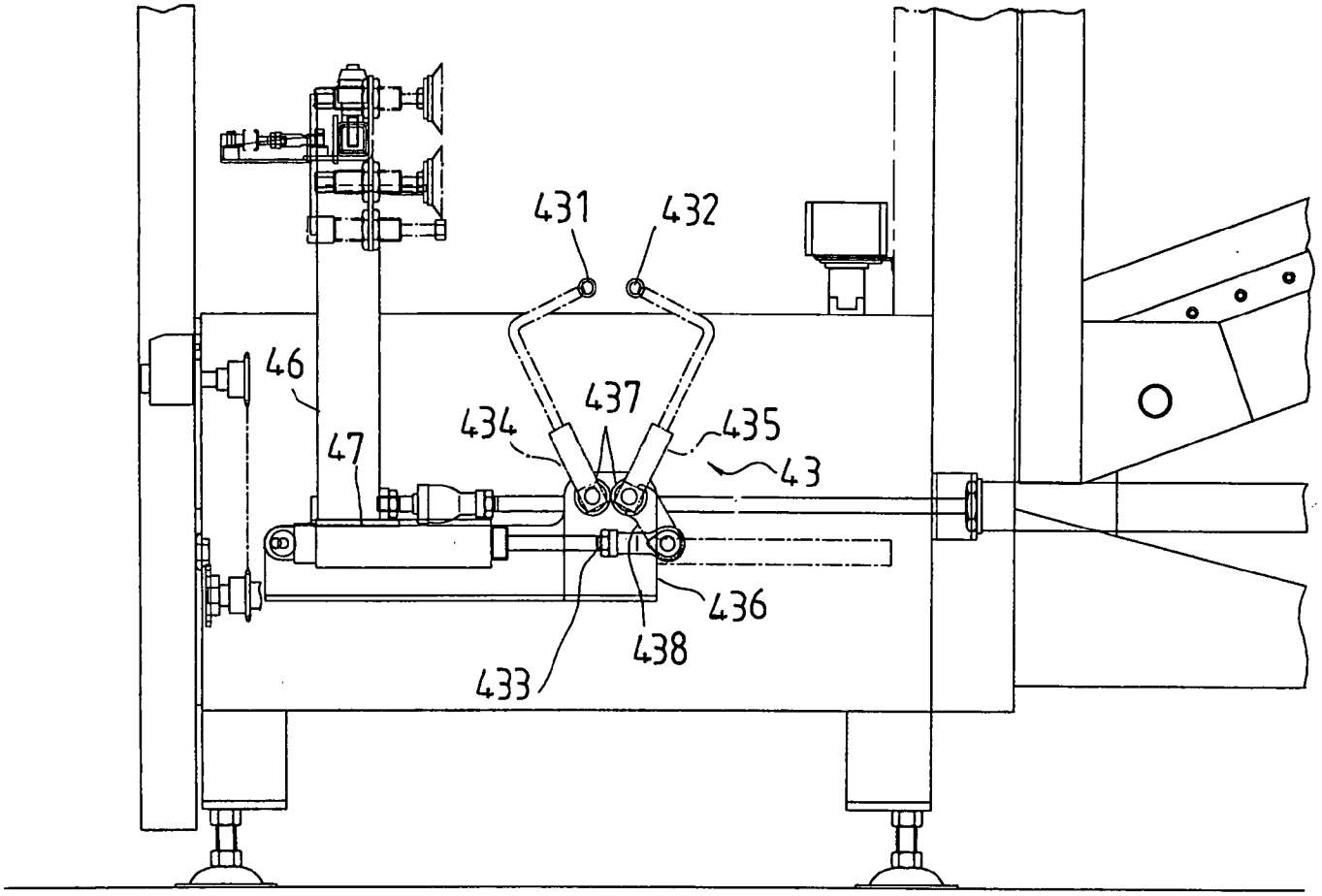
FIG. 15 is a fourth partial side view of the machine of the invention.
Figure 18:
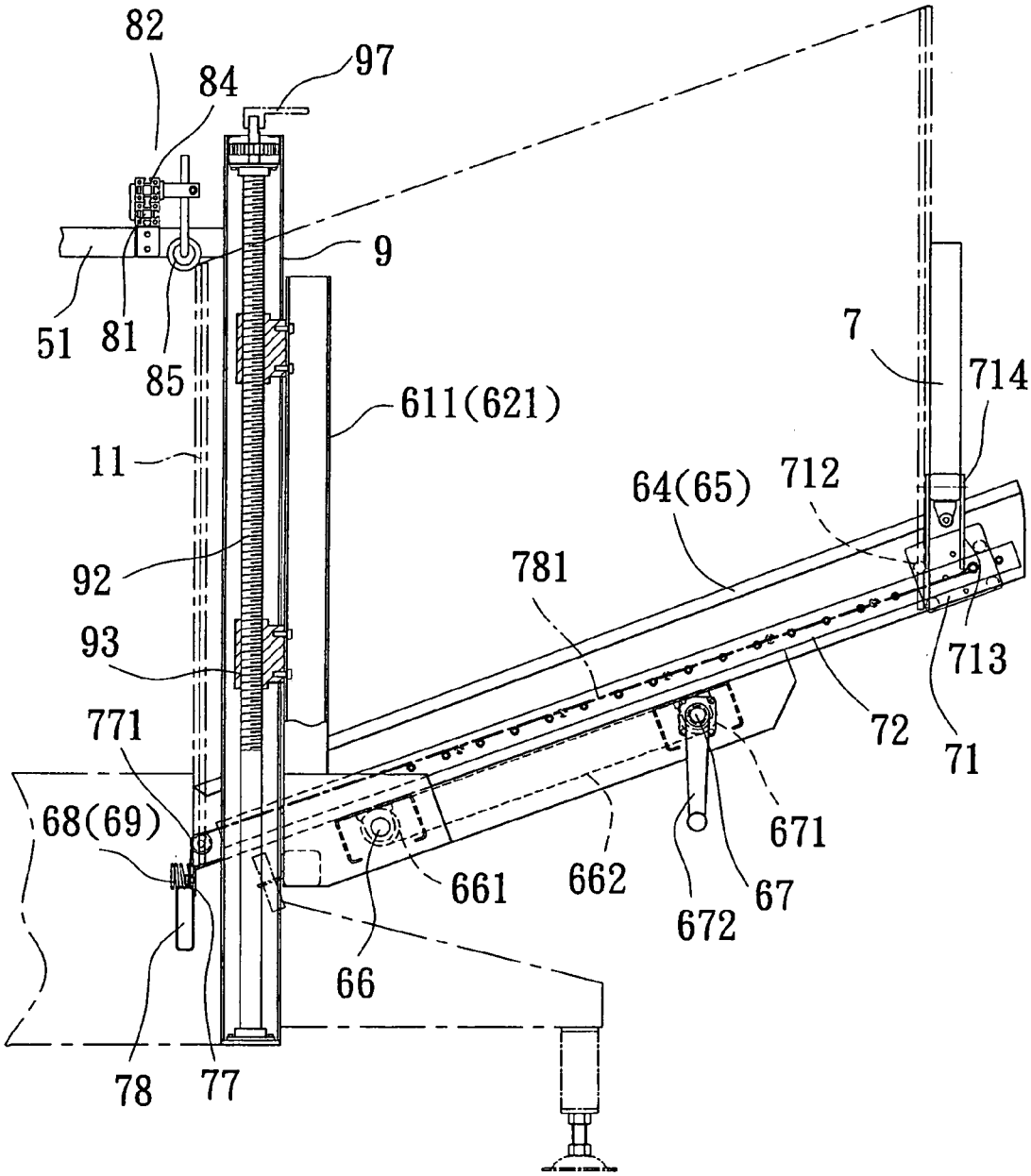
FIG. 18 is a partial front-facing vertical section of the machine of the invention.
Figure 19:
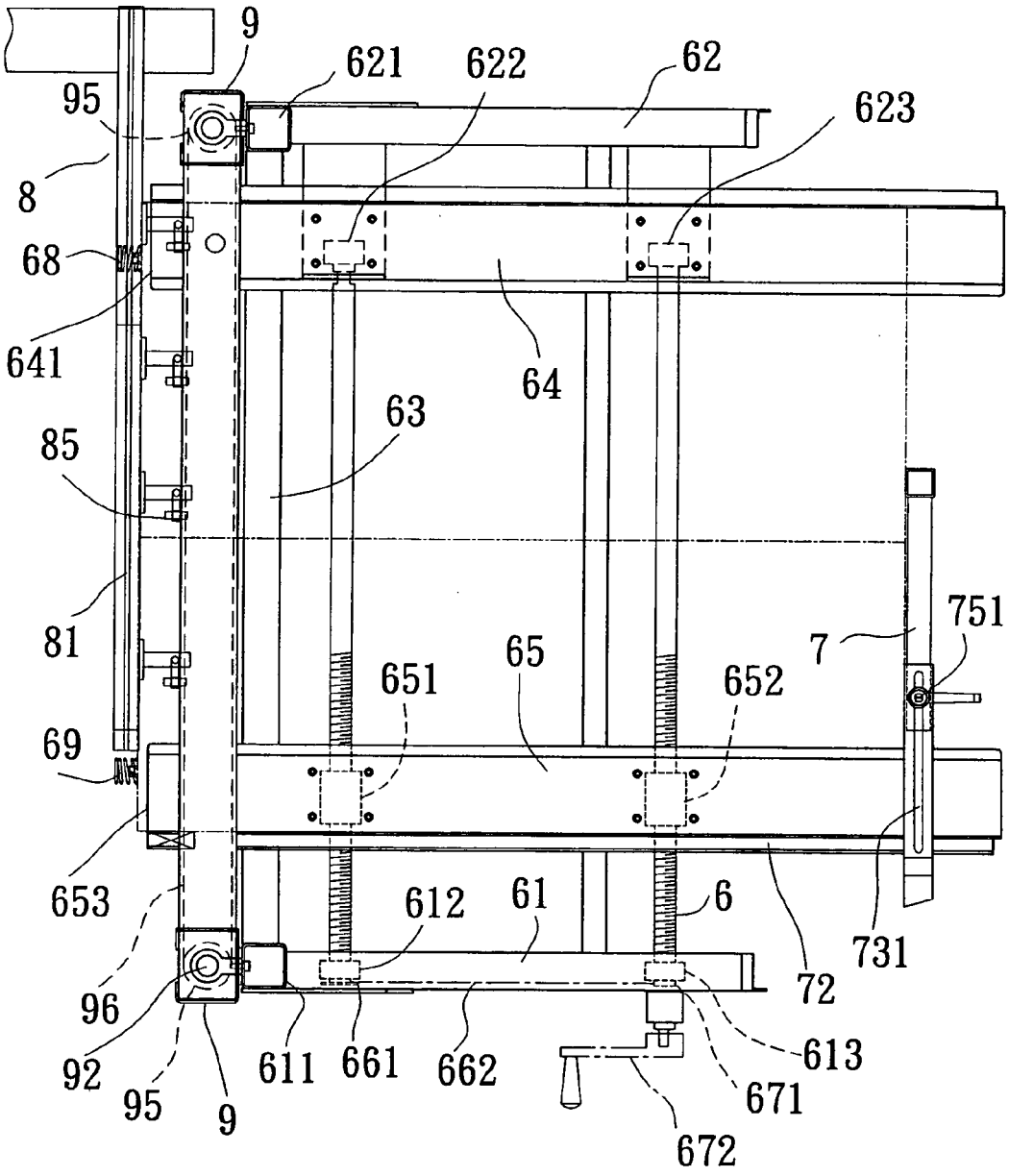
FIG. 19 is a partial horizontal section of the machine of the invention.
Figure 20:
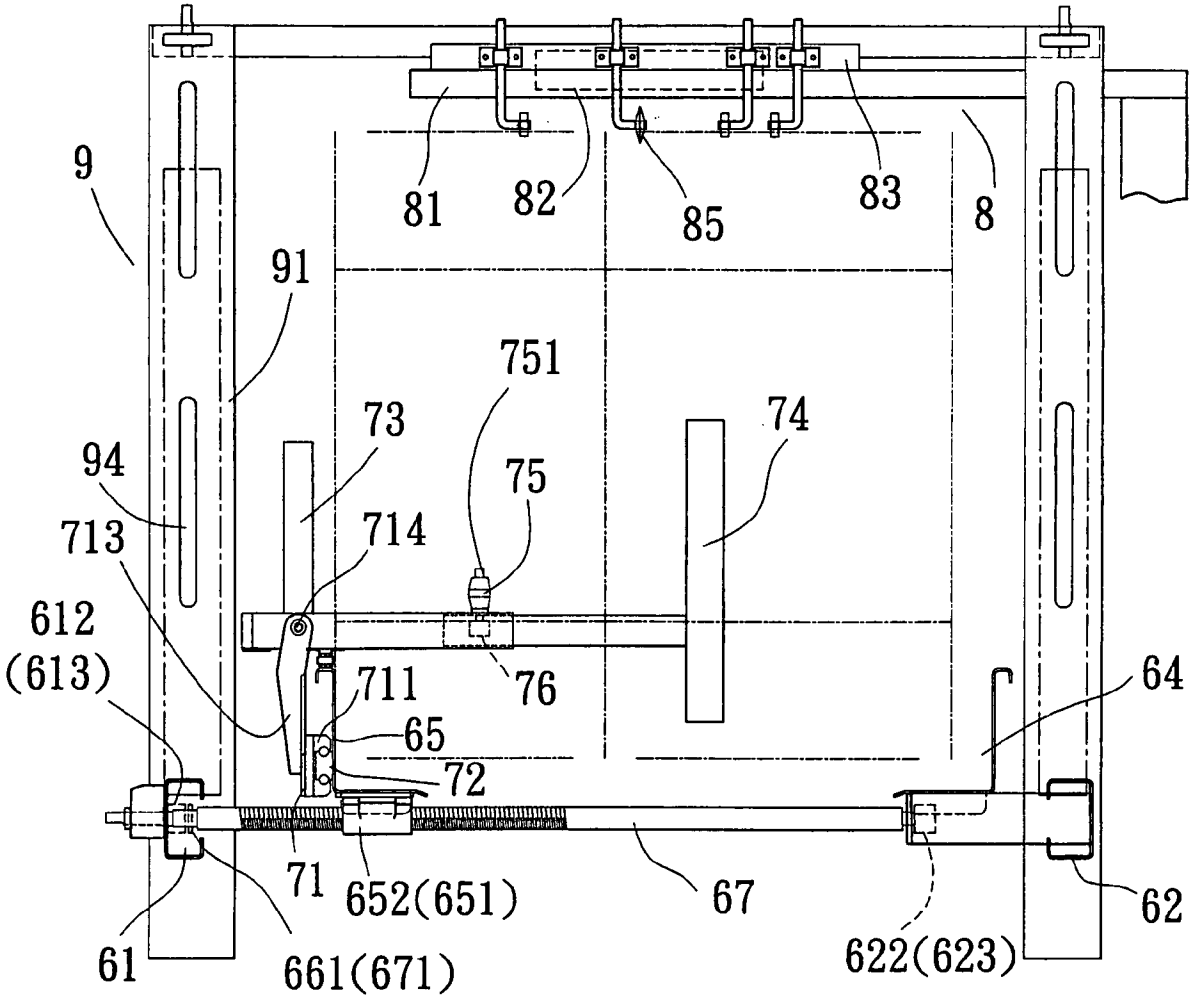
FIG. 20 is a partial vertical section of the machine of the invention, which faces one lateral side.
Figure 21:
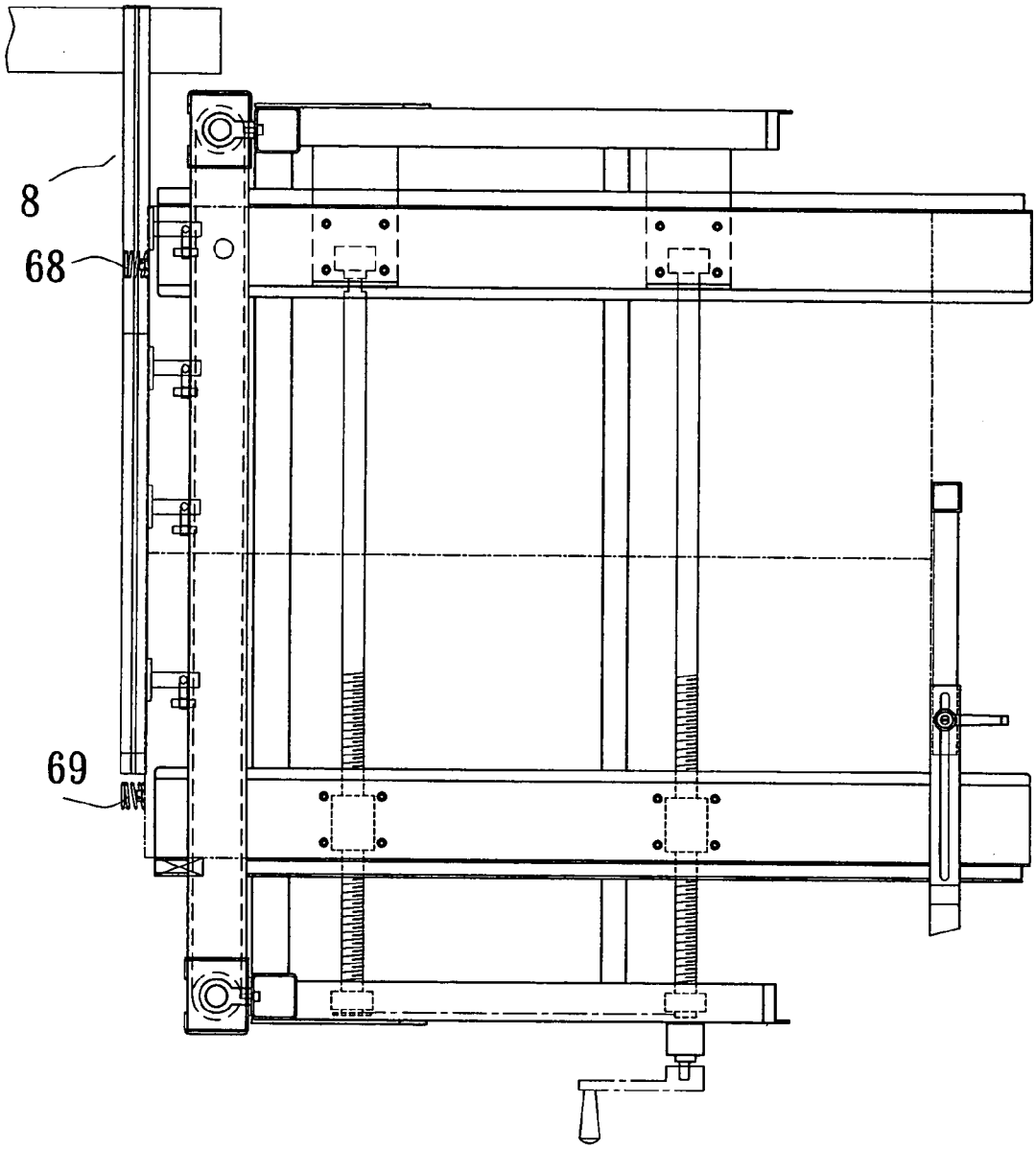
FIG. 21 is a first partial top view of the machine in operation.
Figure 22:
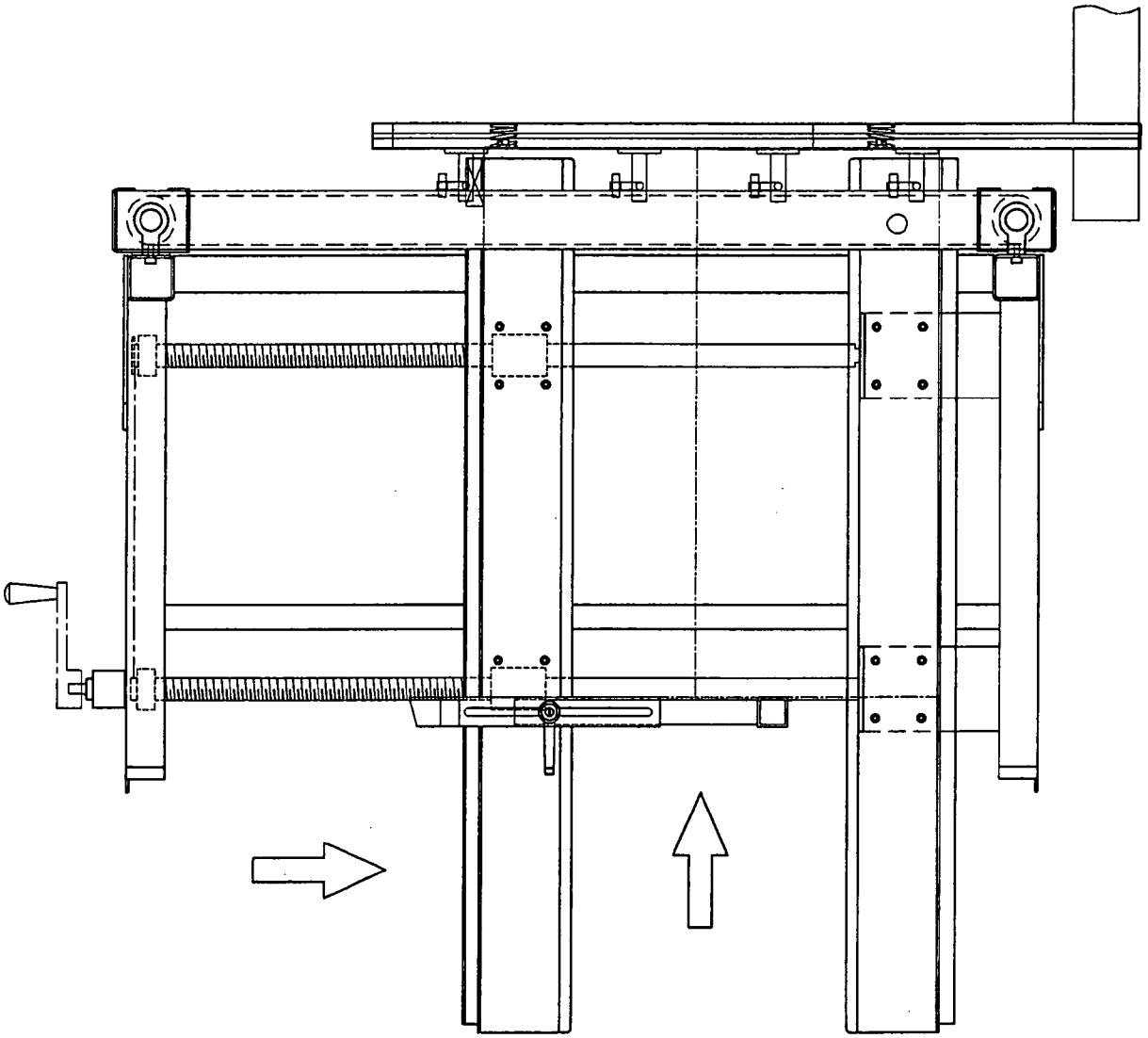
FIG. 22 is a second partial top view of the machine in operation.
Figure 23:
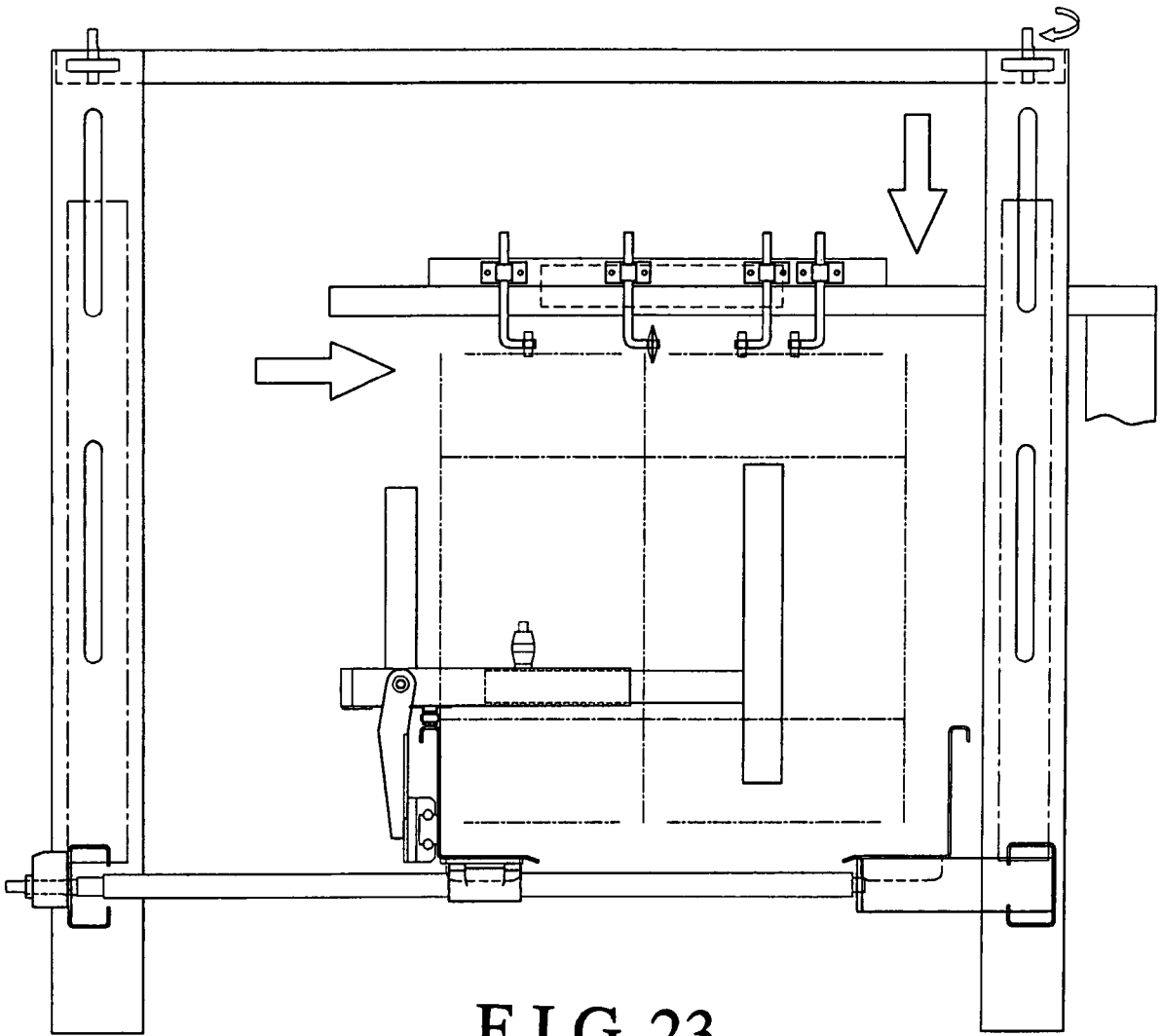
FIG. 23 is a partial side view of the present machine in operation.

Referring to FIGS. 1, 2, 3, 18, and 19, a preferred embodiment of an automatic machine for spreading out cardboard boxes in the present invention includes:

- a machine main body 1 for spreading out cardboards 11, which are made in such manner that they can be made to become box-shaped; the machine main body 1 has sloping guide plates 12, a projecting base 13, conveying belts 14, and a adhesive tape applying member 15;
- a sucking disk set 2; referring to FIGS. 4 to 6, the sucking disk set 2 has several sucking disks 21, and support boards 22; the sucking disks 21 are fitted to the support board 22 by means of adjustment screw bolts 211; one of the support boards 22 has several first adjustment rods 221 thereon while other one of the support boards 22 has second adjustment rods 222 thereon, each of which is between every adjacent two of the first adjustment rods 221; each of the adjustment rods 221, 222 has a holding rod 2211 (2221), and an insertion rod 2212 (2222); the insertion rods 2212, 2222 have locating elongated trenches 2214, 2224 thereon while adjustment screw bolts 2213, 2223 are joined to the holding rods 2211, 2221, and screwed into the locating elongated trenches 2214, 2224; the sucking disks 21 are respectively fitted to the holding rods 2211 and the insertion rods 2212 of the first adjustment rods 221, as shown in FIGS. 7 to 9; the support boards 22 are pivoted to upright rods 23, and are joined to slide blocks 231 at lower ends; the slide blocks 231 are fitted on slide rails 24, and are securely joined to output rods 251 of horizontal cylinders 25 such that the sucking disks 21 can be horizontally displaced; the support boards 22 and the upright rods 23 have projecting ears 223, 232 on outward sides, and sloping cylinders 26 are pivoted to the projecting ears 223, 232 such that the support boards 22 and the sucking disks 21 on the board 22 can be angularly displaced, as shown in FIG. 10; the support boards 22 have an adjustable touching rod 224 (FIG. 5) for coming into contact with cardboards 11 sucked to the sucking disks 21 with proper force; a horizontally positioned screw bolt 27 is disposed to face outward side of the slide rails 24, and a locating base 28 is screwed onto the screw bolt 27, as shown in FIGS. 5, 6, 16, and 17; the screw bolt 27 has a chain wheel 271 fixed to one end thereof, and a chain 273 is connected to the chain wheel 271 and a chain wheel 274, which is connected to an inward end of an adjustment rod 273, such that the locating base 28 can be adjusted; the locating base 28 has a touching rod 281 fitted thereto for coming into contact with the upright rods 23 on the slide blocks 231 so as to limit the rightward movement of the whole sucking disk set 2;

a pushing mechanism 3, as shown in FIGS. 11 to 13; the pushing mechanism 3 has a base 31, a pushing cylinder 32 fitted on the base 31; an output rod 33 of the cylinder 32 is securely joined to a pushing board 34 at outer end, which board 34 has a guiding curved portion 35 such that when cardboards 11 are being spread out, the cardboards 11 can become lozenge, and then become rectangular with the help of the guiding curved portion 35; a sliding rod 36 and tube 37 combination is provided such that the pushing board 34 can move smoothly;

a bending mechanism 4 connected to the sloping guide plates 12 and the projecting base 13 of the machine main body 1; the bending mechanism 4 includes front and rear tapping boards 41, 42, and a lateral tapping rod set 43, as shown in FIGS. 11 to 13; the front tapping board 41 is fitted to an auxiliary support board 44, and is actuated by means of a cylinder 411; the auxiliary support board 44 has a down extending support portion 441 as well as an upright support 46 while the cylinder 411 is pivoted to a lower end of the support portion 441 at a lower end, and is actuated with a cylinder 45; in other words, the cylinder 45 is pivoted to an extending portion 311 of the base 31, and an output rod of the cylinder 45 is pivoted to the support board 44; a support rod 442 is fitted on a left side of the auxiliary support board 44, and pivoted to a projecting ear 461 formed on top of the upright support 46; the upright support 46 and the base 31 are joined together at lower end portions thereof by means of a transverse support body 47; there are slide bases 462, 312 under the transverse support body 47, and there are left and right slide rails 471, 472 fitted to the bases 462, 312 such that the bases 462, 312 can be moved forwards and backwards;

a screw tube 473 is disposed between the slide bases 462 and 312 under the transverse support body 47 while a guide screw rod 48 is screwed into the screw tube 473; a bevel gear 481 is securely joined to the guide screw rod 48, and engages a bevel gear 482, which is securely joined to an adjustment rod 483; a handle 484 is securely joined to the adjustment rod 483 such that the pushing mechanism 3, the front tapping board 41, and the auxiliary support board 44 together can be forwards and rearwards adjusted by means of turning the handle 484;

the rear tapping board 42 is angularly displaceable between the sloping guide plates 12 of the machine main body 1, and is connected to an output rod 423 of a cylinder 422 at projecting ears 421 thereof such that it can be made to perform tapping movement by the cylinder 422, which cylinder 422 is angularly displaceable within the projecting base 13;

the lateral tapping rod set 43 is arranged between the front and the rear tapping boards 41 and 42, as shown in FIGS. 12 to 14, and includes left and right tapping rods 431, 432, and a cylinder 433; the left and right tapping rods 431, 432 have rod bodies 434, 435; the rod bodies 434 and 435 are pivoted to a projecting support board 436, and gears of a gear set 437, which engage each other, are respectively securely joined to the rod bodies 434, 435; a cylinder 433 is pivoted to a projecting ear 438 of the rod body 455 at an output rod thereof such that the left and right tapping rods 431, 432 can be angularly displaced closer to each other and away from each other at the same time, as shown in FIG. 15;

a pressing mechanism 5, which has lateral supports 52, and an inverted U-shaped movable support 51 passed through the lateral supports 52, as shown in FIGS. 1 to 3; the movable support 51 has screw rods 53 in two lateral portions thereof, which screw rods 53 are formed with chain teeth 531, while a chain 54 is passed over the chain teeth 531 of the screw rods 53; one of the screw rods 53 projects upwards from top of the movable support 51, and has a handle 55 fitted to the upper end thereof such that both the screw rods 53 can be turned by means of operating the handle 55; the lateral supports 52 have screw tubes 56 therein, and both the screw rods 53 are respectively screwed into the screw tubes 56 such that the whole movable support 51 can be moved up and down, and such that a pressing board 57, which is joined to the movable support 51, can be pressed against top of a cardboard 11 with appropriate force while the bending mechanism 4 is functioning to bend bottom shutter portions of the cardboard 11, thus helping the bending mechanism 4 bend the bottom shutter portions of the cardboard 11 smoothly;

a material holding mechanism 6, which has front and rear sloping supports 61, 62, transverse support rods 63; the front and the rear sloping supports 61, 62 respectively have upright support rods 611, 621 at first ends, and are joined together with the help of the transverse support rods 63; a fixed guiding support 64 is arranged facing an inward side of the rear sloping support 62 while a movable auxiliary support 65 is provided between the front and the rear sloping supports 61, 62; there are at least two pairs of opposing holding tubes 612, 622 and 613, 623 in the front and the rear sloping supports 61, 62 while two guiding screw rods 66, 67 are screwed into respective pairs of opposing holding tubes 612, 622 and 613, 623; the guiding screw rods 66, 67 have gears 661, 671 securely joined to first ends while a chain 662 is passed over the gears 661 and 671; the guiding screw rods 66, 67 have handles 672 fitted to second ends, as shown in FIGS. 18 to 20; screw tube 651 and 652 are fitted to bottom of the auxiliary support 65, and the guiding screw rods 66, 67 are respectively screwed into the screw tubes 651, 652 such that the auxiliary support 65 is steady, an such that the auxiliary support 65 can be adjusted in position for suiting different sizes of cardboards by means of turning the handles 672, as shown in FIGS. 21 to 23;

the fixed guiding support 64 and the movable auxiliary support 65 are respectively formed with lower end portions 641, 651 projecting down into the machine main body 1; the lower end portions 641, 651 respectively have front and rear springs 68, 69 fitted thereon, and the front and the rear springs 641, 651 are slightly higher than a plane on the fixed guiding support 64 and the movable auxiliary support 65, on which the cardboards are supported, such that a lower stopping mechanism is formed for lower ends of the cardboards to come into contact with;

a pressing base 7, which have guide rails 72, and slide bases 71, as shown in FIGS. 18 to 21; the guide rails 72 are disposed in a sloping position on the auxiliary support 65; the slide bases 71 have linear slide blocks 711 (FIG. 20) and guide wheels 712 (FIG. 18) therein, and are fitted on the guide rails 72 such that the pressing base 7 can be up and down displaced along a slope on the auxiliary support 65 with the help of the guide rails 72; the slide bases 71 are formed with projecting ears 713 thereon while pressing rods 73 are pivoted to the projecting ears 713 by means of pivotal shafts 714; extension supports 74 are fitted on the pressing rods 73; the extension supports 74 have locating blocks 76 arranged therein as well as rotary handles 75 connected with the locating blocks 76 thereof while the pressing rods 73 have elongated holes 731 thereon; screw rods 761 are passed through the elongated holes 731 such that length of those portions of the extension supports 74 that project outwards can be adjusted by means of turning the rotary handles 75; a supporting part 77 is secured to lower end of the auxiliary support 65, and counterweights 78 are secured to the supporting part 77; pulling ropes 781 are passed over pulleys 771, and connected to the slide bases 71 such that the slide bases 71 are biased inwardly of the machine main body 1;

an upper stopping mechanism 8, as shown in FIGS. 3 and 18 to 20, which consists of a fixed rod 81, two fixed opposing support boards 82 on two sides of the fixed rod 81, and extending rods 3 movably fitted on the support boards 82; knobs (not numbered) are provided for releaseably securing the extending rods 3 in position such that length of those portions of the extending rods 3 that project outwards can be adjusted by means of turning the knobs; support bases 84 are arranged next to the fixed rod 81 and the extending rods 3, and stopping wheels 85 are fitted under the support bases 83 for coming into contact with cardboards; the upper stopping mechanism 8 is further fitted in the lateral supports 52 with the help of the fixed rod 81 thereof as well as the movable support 51 of the pressing mechanism 5 such that it can be moved up and down together with the movable support 51;

a main lateral support 9, as shown in FIGS. 6 to 20, which has an inverted U-shape, and has a vertical supporting part 91; screw tubes 93 are arranged in the vertical supporting part 91, and vertical screw rods 92 are screwed into the screw tubes 93; the screw tubes 93 are securely joined to fitting holes 6111, 6211 of the upright support rods 611, 621, and passed through elongated holes 94; the vertical screw rods 92 have gears 95 connected thereto, and a chain 96 is passed over the gears 95 such that the material holding mechanism 6 can be adjusted in height for suiting cardboards of various different dimensions by means of turning a hand wheel 97, which is joined to one of the vertical screw rods 92.

In using the machine of the present invention, first the sucking disks 21 are adjusted in respect of the size of space between them by means of the first and the second adjustment rods 221, 222 of the sucking disk set 2, and the size of space between the auxiliary support 65 and the fixed guiding support 64 is adjusted by means of turning the handles 672, which space will be used as holding room for cardboards 11. And, the pressing rods 73 and the extension supports 74 of the pressing base 74 are upwards displaced by means of the pivotal shafts 714 such that a pressing section 715 is pressed against a recess between the projecting ears 713, and such that the pressing rods 73 and the extension supports 74 are completely outside the holding area for allowing cardboards to be put in the holding area. Then, intended number of cardboards 11 are put in the holding areas side by side in upright position; a first one of the cardboards 11 will be stopped from falling into the machine main body 1 at upper and lower ends thereof by the stopping wheels 85 of the upper stopping mechanism 8 as well as by the front and the rear springs 68, 69 of the lower stopping mechanism, as shown FIGS. 1 and 18 to 20, and those cardboards 11 that are behind the first one will be side by side in upright position owing to the above stoppage. Third, the pressing base 7 is pushed upwards along the sloping guide rails 72 until it is in the vicinity of a last one of the cardboards 11, and then the pressing rods 73 and the extension supports 74 are made to move down into the holding area such that owing to the weight of the whole pressing base 7 and the counterweights 78 (FIG. 18), the pressing rods 73 and the extension supports 74 are pressed against the last cardboard 11 to prevent the cardboards 11 from falling down until the last cardboard 11 is drawn into the machine main body 1.

Figure 16:
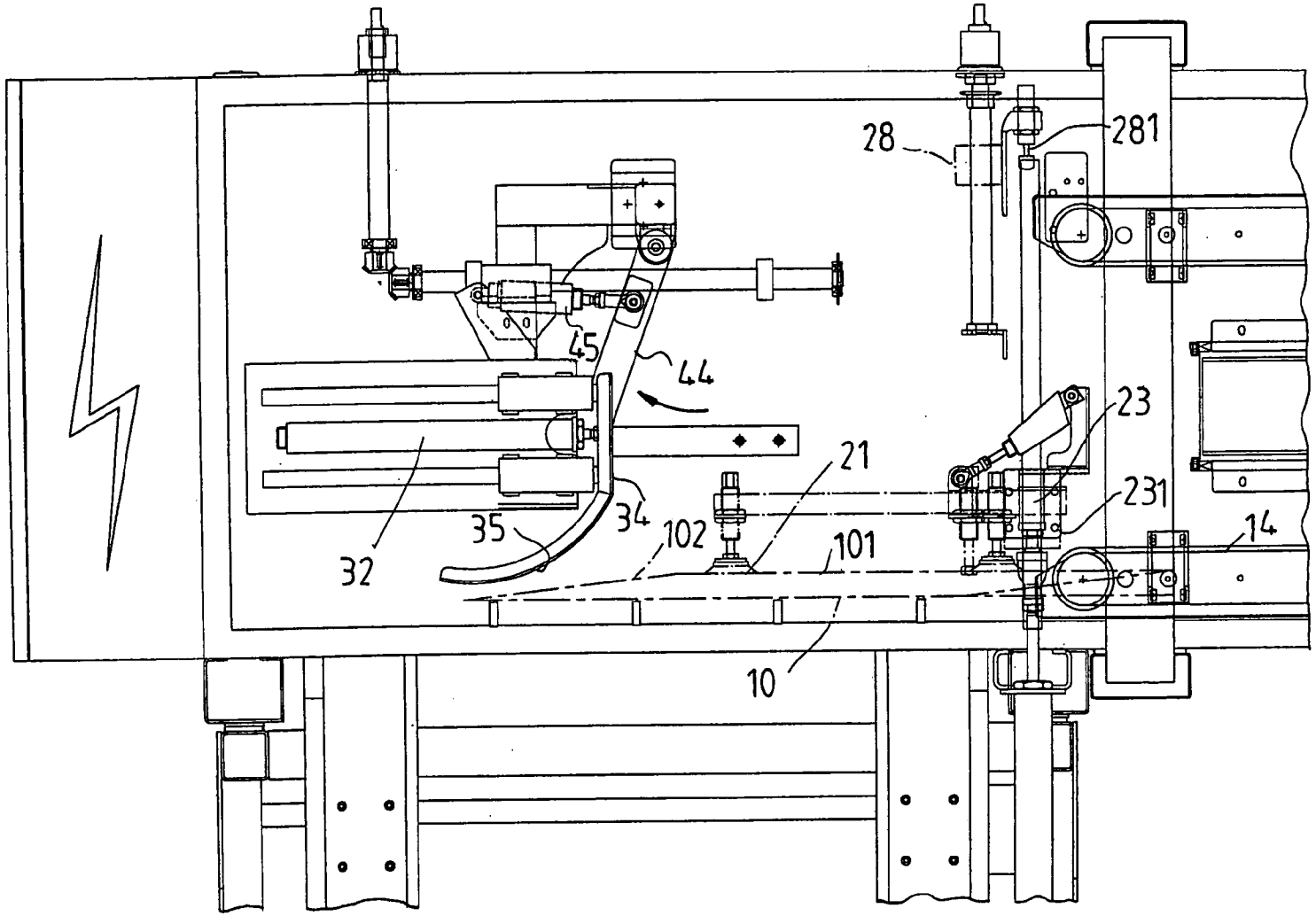
FIG. 16 is a first view of the present machine in operation.
Figure 17:
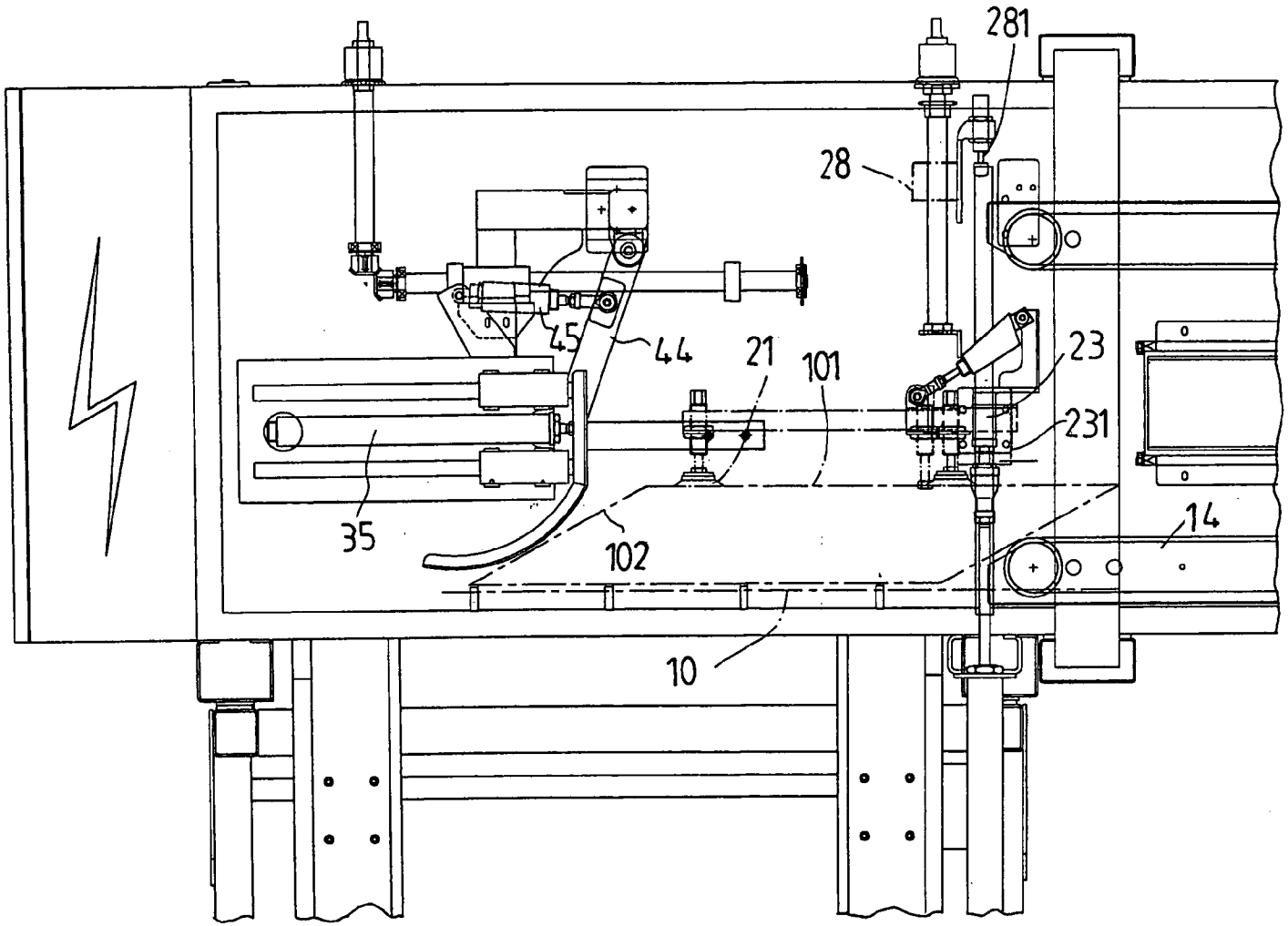
FIG. 17 is a second view of the present machine in operation.
Figure 24:
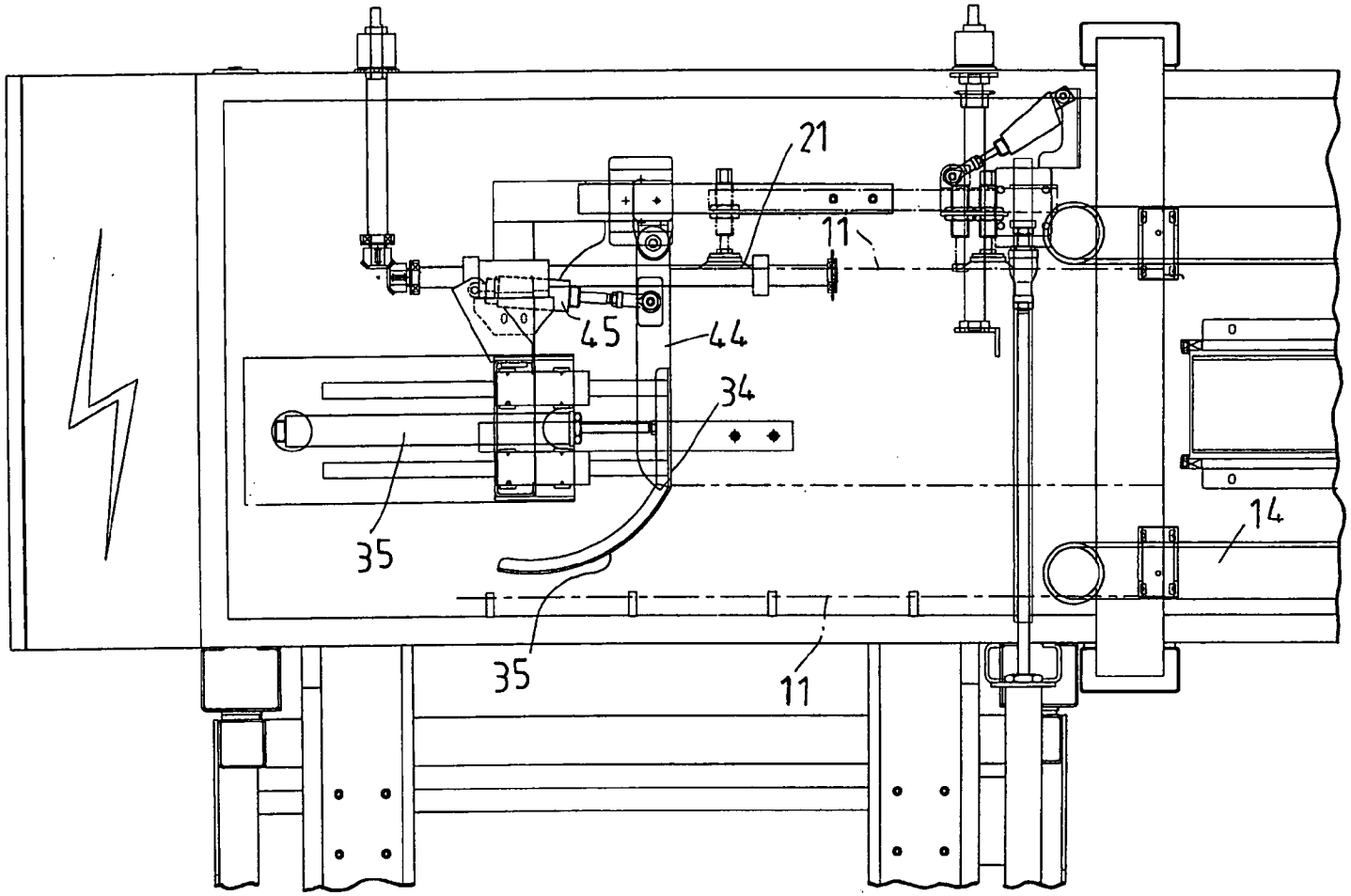
FIG. 24 is a partial view of the present machine in operation.
Figure 25:
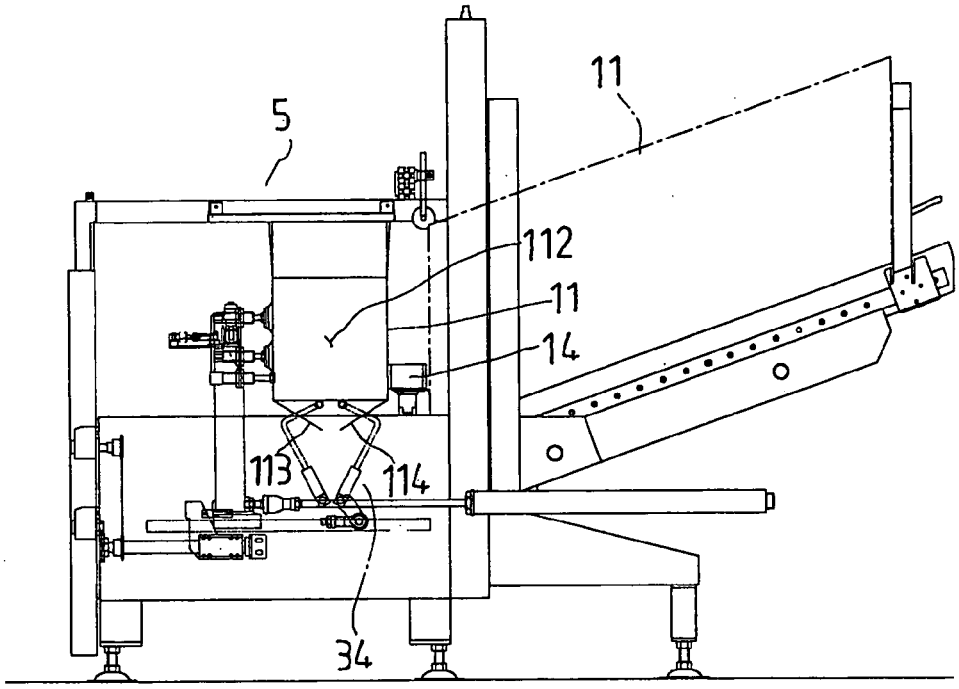
FIG. 25 is a side view of the present machine in operation.
Figure 27:
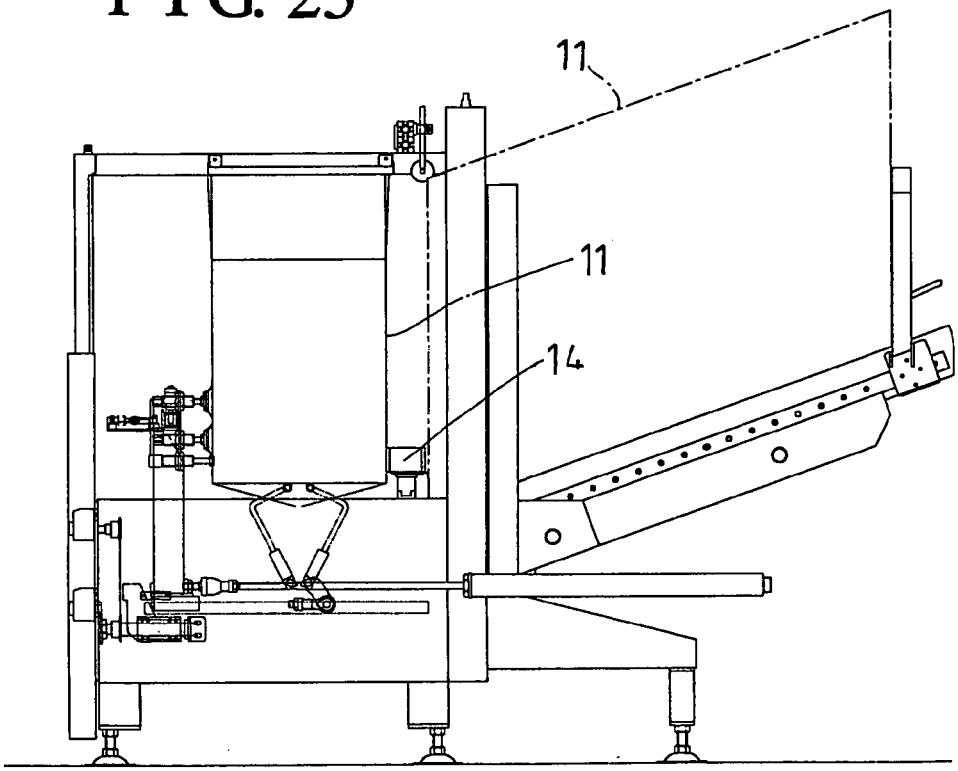
FIG. 27 is another side view of the machine in operation.
Figure 26:
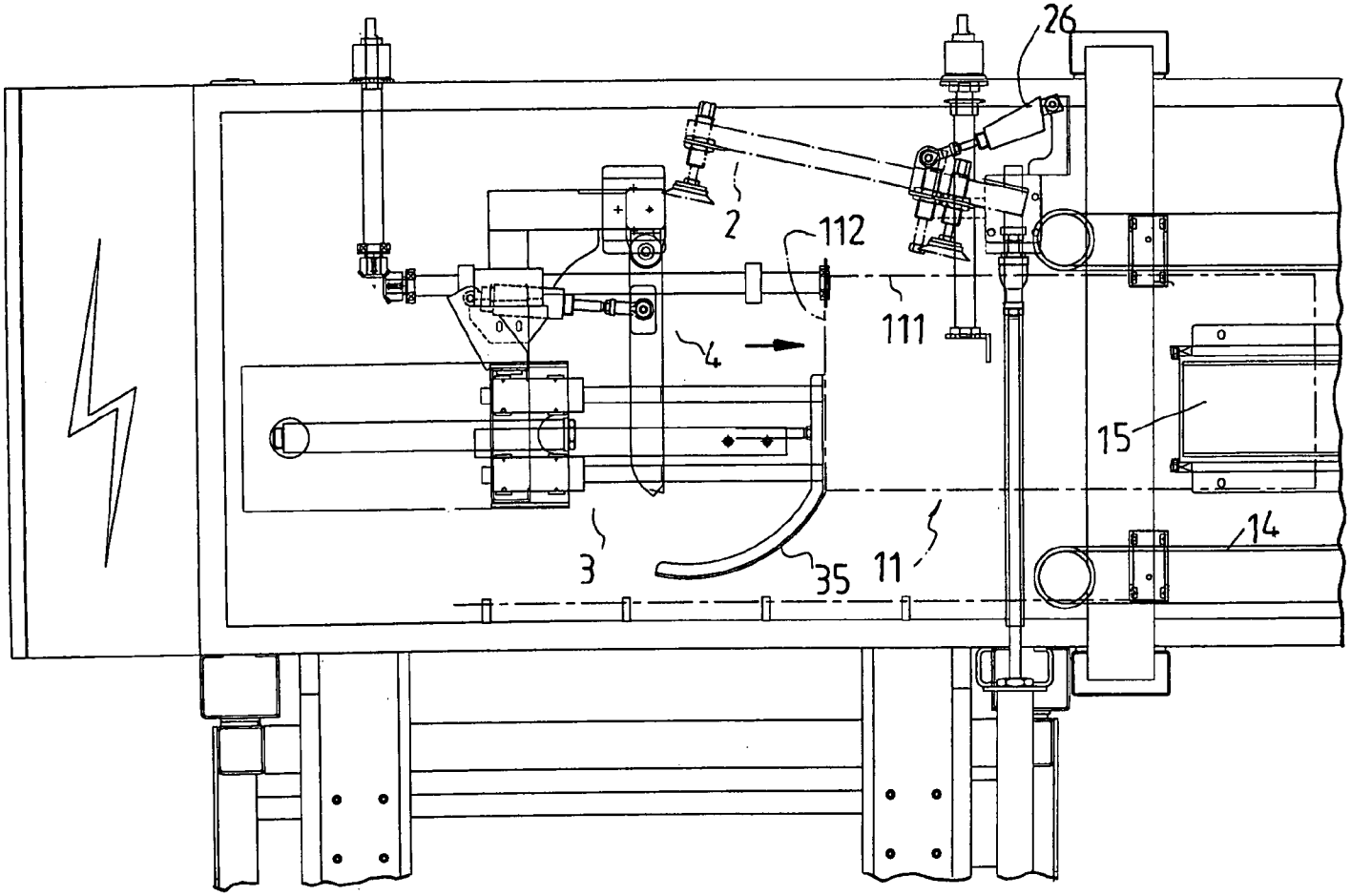
FIG. 26 is a third partial top view of the machine in operation.

After the above actions, left side of a cardboard 11 is sucked to the sucking disks 21, and the horizontal cylinder 25 functions such that the sucking disks 21 are leftwards displaced; thus, the cardboard 11 changes from flat shape into lozenge one, and is spread out finally with front, rear, and lateral sides thereof forming four straight angles, as shown in FIGS. 16, 17, and 24, and the slide block 231 is stopped by the touching rod 281 at the same time. When the sucking disks 21 are drawing the cardboard 11, the cardboard 11 will tilt gradually, and the front side 112 of the cardboard 11 will touch the guiding curved portion 35, and be in front of and parallel to the pushing board 34 with the help of the guiding curved portion 35.

When the cardboard 11 is nearly spread out into a box-shape, the cylinder 45 will push the auxiliary support board 44 to make the same pressed against the front side 112 of the cardboard 11 such that the cardboard 11 sucked to the sucking disks 21 become completely spread out, i.e. with four lateral sides forming four straight angles. Then, the front and the rear tapping boards 41, 42 are made to tap front and rear shutter portions of the bottom of the cardboard 11 such that the front and the rear shutter portions are folded upwards and inwardly of the box. Next, the lateral tapping rod set 43 is made to tap lateral shutter portions 113, 114 of the bottom of the cardboard 11 to fold the same inwardly of the box. Next, the cylinder 32 of the pushing mechanism 3 makes the pushing board 34 move forwards to push the front side 112 of the cardboard 11, and at the same time the sucking disks 21 stop sucking the cardboard 11, and are moved outwards together with the support board 22 by means of the sloping cylinder 26 for allowing the cardboard 11 to move to the conveying belts 14. Finally, the pushing board 34 pushes the cardboard 11 to the conveying belts 14, and at the same time the adhesive tape applying member 15 between the conveying belts 14 makes adhesive tape stick to the bottom lateral shutter portions 113, 114 of the box made of the cardboard 11; thus, the box is ready for use when it is conveyed outside the machine.

Furthermore, an embodiment of a machine for spreading out larger cardboard boxes is shown in FIG. 17.

From the above description, it can be easily understood that the machine for spreading out cardboard boxes in the present invention has advantages over the conventional ones as followings:

1. Cardboard boxes are in upright position with openings thereof facing up when they are spread out and sealed at the bottom in the present invention while cardboard boxes are not upright with openings thereof facing up, and have to be turned to the desired upright position when they are spread out with the conventional machines. Therefore, the present machine is more convenient to use.
2. The bending mechanism, which is used for tapping bottom shutter portions of cardboard boxes to fold the same, are always next to four sides of lower ends of the cardboards, and don't have to move around to perform the tapping action. Therefore, the bending mechanism won't increase the length of the whole machine.
3. Cardboards are positioned upright side by side in the material holding mechanism, and boxes are upright with openings facing up such that the boxes can be used right after they are conveyed outside the present machine.
4. Because cardboards are positioned upright side by side in the material holding mechanism, they will occupy the smallest space, and the whole operation of the machine is simplified.
5. Because the material holding mechanism is close to the machine main body, the length of the whole machine is shortened. In other words, the machine occupies less space.
6. The sucking disks can be adjusted in position as well as length of space between them for suiting different situations. Therefore, the present machine is convenient to use.

What is claimed is:

1. A machine for spreading out cardboard boxes, comprising a material holding mechanism for holding cardboards thereon;

a machine main body next to the material holding mechanism; the cardboards being conveyed into the machine main body from the material holding mechanism, and being spread out and folded at bottom shutter portions thereof in the machine main body; the cardboards being sealed at the bottom shutter portions with a adhesive tape applying member, and conveyed outside the machine main body after being sealed at the bottom;

a sucking disk set arranged in the machine main body; the sucking disk set having a plurality of sucking disks for drawing one of four lateral portions of a cardboard thereto and moving the lateral portion so as to making the lateral portions form four substantially straight angles between them; the sucking disks being displaced with horizontally positioned cylinders to move the cardboard;

a bending mechanism for bending bottom shutter portions of the cardboards with; the bending mechanism having front and rear tapping boards, and two lateral tapping rods for respectively bending front, rear and lateral shutter portions of bottoms of the cardboards with; the bending mechanism having an auxiliary support board connected with the front tapping board for pushing a front one of the lateral portions of the cardboards to make the lateral portions form four exactly straight angles between them before the tapping boards and tapping rods begin functioning; and a pushing mechanism arranged in the machine main body for pushing spread out cardboard boxes to conveying belts after the shutter portions of bottoms of the cardboards are bent and after the boxes are released from the sucking disks; the boxes being sealed at bottoms with the adhesive tape applying member after being pushed to the conveying belts; the pushing mechanism having a pushing board for touching the cardboards; the pushing mechanism having a pushing cylinder for moving the pushing board with.

2. The machine for spreading out cardboard boxes as claimed in claim 1, wherein the sucking disks are to draw the cardboards one after another, and the sucking disk set further has:

a support board; the sucking disks being fitted to the support board by means of adjustment screw bolts; the support board being pivoted to an upright rod;

a slide block, the support board being joined to a slide block at a lower end; the slide block being fitted on slide rails, and being securely joined to an output rod of a horizontal cylinder such that the sucking disks can be horizontally displaced; the support board and the upright rod having projecting ears on outward sides;

a sloping cylinder pivoted to the projecting ears of the support board and the upright rod such that the support board and the sucking disks on the board can be angularly displaced; the support board having an adjustable touching rod for coming into contact with cardboards drawn to the sucking disks;

a horizontally positioned screw bolt disposed to face outward side of the slide rails;

a locating base screwed onto the horizontally positioned screw bolt; the horizontally positioned screw bolt having a chain wheel fixed to one end thereof; and a chain connected to the chain wheel and a second chain wheel, which is connected to an inward end of an adjustment rod, such that the locating base can be adjusted; the locating base having a touching rod fitted thereto for coming into contact with the upright rod on the slide block so as to limit the rightward movement of the whole sucking disk set.

3. The machine for spreading out cardboard boxes as claimed in claim 1, wherein the pushing mechanism includes:

a base and a pushing board; and a pushing cylinder fitted on the base; an output rod of the cylinder being securely joined to the pushing board at outer end; the pushing board having a guiding curved portion such that when cardboards are being spread out, the cardboards can become lozenge, and then become rectangular gradually with help of the guiding curved portion.

4. The machine for spreading out cardboard boxes as claimed in claim 1, wherein the bending mechanism includes front and rear tapping boards, and a lateral tapping rod set; the front tapping board being fitted to an auxiliary support board, and actuated by means of a first cylinder; the auxiliary support board having a down extending support portion; the first cylinder being pivoted to a lower end of the down extending support portion at a lower end, and actuated with a second cylinder; the second cylinder being pivoted to an extending portion of a base of the pushing mechanism; an output rod of the second cylinder being pivoted to the auxiliary support board; a support rod being fitted on a left side of the auxiliary support board, and pivoted to a projecting ear formed on top of an upright support.

5. The machine for spreading out cardboard boxes as claimed in claim 1, wherein a pressing mechanism is arranged on two sides of the machine main body; the pressing mechanism including lateral supports, and a movable support fitted to the lateral supports; the pressing mechanism having a pressing board joined to the movable support so as to be capable of being pressed against top of a cardboard while the bending mechanism is functioning to bend bottom shutter portions of the cardboard, thus preventing the cardboard from moving upwards.

6. The machine for spreading out cardboard boxes as claimed in claim 5, wherein the movable support of the pressing mechanism has an inverted U-shape, and is passed through the lateral supports 52; the movable support having screw rods in two lateral portions thereof; a chain being passed over the screw rods; a first one of the screw rods projecting upwards from top of the movable support; a handle being fitted to the upper end of the first screw rod such that both the screw rods can be turned by means of operating the handle; the lateral supports 52 having screw tubes therein; both the screw rods being respectively screwed into the screw tubes such that the inverted U-shaped movable support can be moved up and down, and such that a pressing board, which is joined to the inverted U-shaped movable support, can be pressed against top of a cardboard while the bending mechanism is functioning to bend bottom shutter portions of the cardboard.

7. The machine for spreading out cardboard boxes as claimed in claim 3 or 4, wherein a transverse support body is joined to lower end portions of both the base of the pushing mechanism and the upright support of the auxiliary support board, to which the front tapping board is joined while there are slide bases fitted under the transverse support body as well as left and right slide rails fitted to the slide bases such that the slide bases can be moved forwards and backwards; a first screw tube being disposed between the slide bases under the transverse support body; a guide screw rod being screwed into the first screw tube; a first bevel gear being securely joined to the guide screw rod, and engaging a second bevel gear, which is securely joined to an adjustment rod; a handle being securely joined to the adjustment rod such that the pushing mechanism, the front tapping board, and the auxiliary support board together can be forwards and rearwards adjusted by means of turning the handle.

8. A machine for spreading out cardboard boxes, comprising a sucking disk set, which have a plurality of sucking disks, and two support boards; the support boards respectively having first adjustment rods, and second adjustment rods thereon; the second adjustment rods being each between every adjacent two of the first adjustment rods; each of the first and the second adjustment rods having a holding rod, and an insertion rod inserted in and displaceable relative to the holding rod; the insertion rods having locating elongated trenches thereon; adjustment screw bolts being connected to the holding rods, and screwed into the locating elongated trenches; the sucking disks being fitted on the holding rods and the insertion rods of the first adjustment rods such that the sucking disks can be adjusted in position as well as length of space between them.

* * * * *